US009724925B2

(12) United States Patent
Nawano et al.

(10) Patent No.: US 9,724,925 B2
(45) Date of Patent: Aug. 8, 2017

(54) LIQUID EJECTING HEAD UNIT, LIQUID EJECTING APPARATUS, WIPING METHOD, AND PRINTING METHOD

(71) Applicant: SEIKO EPSON CORPORATION, Tokyo (JP)

(72) Inventors: Masahisa Nawano, Suwa (JP); Hiroaki Okui, Azumino (JP); Yasuyuki Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/163,483

(22) Filed: May 24, 2016

(65) Prior Publication Data

US 2016/0347068 A1 Dec. 1, 2016

(30) Foreign Application Priority Data

May 28, 2015 (JP) ..... 2015-109079

(51) Int. Cl.

| | |
|---|---|
| ***B41J 2/14*** | (2006.01) |
| ***B41J 2/16*** | (2006.01) |
| ***B41J 2/165*** | (2006.01) |
| ***B41J 2/155*** | (2006.01) |

(52) U.S. Cl.

CPC ..... *B41J 2/16538* (2013.01); *B41J 2/14233* (2013.01); *B41J 2/155* (2013.01); *B41J 2002/14362* (2013.01); *B41J 2002/14419* (2013.01); *B41J 2002/16502* (2013.01); *B41J 2002/16558* (2013.01); *B41J 2202/20* (2013.01)

(58) Field of Classification Search

CPC ..... B41J 2002/1657; B41J 2/1623; B41J 2/16535; B41J 2/16538; B41J 2/155; B41J 2/14233; B41J 2202/20; B41J 2002/14362; B41J 2002/14419; B41J 2002/16502; B41J 2002/16558

See application file for complete search history.

(56) References Cited

U.S. PATENT DOCUMENTS

| | | | | |
|---|---|---|---|---|
| 5,355,158 | A | 10/1994 | Inada et al. | |
| 5,557,306 | A | 9/1996 | Fukushima et al. | |
| 6,099,109 | A * | 8/2000 | Komuro | B41J 2/14024 347/50 |

(Continued)

FOREIGN PATENT DOCUMENTS

| | | |
|---|---|---|
| JP | 03-293140 | 12/1991 |
| JP | 07-096604 | 4/1995 |

(Continued)

*Primary Examiner* — Matthew Luu
*Assistant Examiner* — Patrick King
(74) *Attorney, Agent, or Firm* — Workman Nydegger

(57) ABSTRACT

A liquid ejecting head unit which includes a liquid ejecting head which includes a nozzle surface provided with nozzles, the nozzle surface being on a plane defined by two directions including a first and a second directions intersecting each other, a wiping unit comprising a wiper parallel to the first direction and configured to perform relative movement in the second direction between the wiper and the nozzle surface to wipe the nozzle surface, a recess defined by an edge provided along the first direction on the nozzle surface, and a controller for filling the recess with a liquid which spills from at least one nozzle among the nozzles, and for wiping the nozzle surface after wiping the recess.

13 Claims, 14 Drawing Sheets

(56) References Cited

U.S. PATENT DOCUMENTS

| | | | | |
|---|---|---|---|---|
| 6,527,370 | B1 * | 3/2003 | Courian | B41J 2/14016 347/47 |
| 8,690,296 | B2 * | 4/2014 | Ciminelli | B41J 2/14024 347/20 |
| 2001/0024219 | A1 * | 9/2001 | Kanda | B05B 1/02 347/47 |
| 2004/0189757 | A1 * | 9/2004 | Yamada | B41J 2/14209 347/86 |
| 2007/0008375 | A1 * | 1/2007 | Tanikawa | B41J 2/14072 347/50 |
| 2009/0309935 | A1 * | 12/2009 | Koseki | B41J 2/14209 347/71 |
| 2015/0202875 | A1 * | 7/2015 | Watanabe | B41J 2/055 347/33 |

FOREIGN PATENT DOCUMENTS

| | | |
|---|---|---|
| JP | 2006-315188 | 11/2006 |
| JP | 2013-193408 | 9/2013 |

* cited by examiner

LIQUID EJECTING HEAD UNIT, LIQUID EJECTING APPARATUS, WIPING METHOD, AND PRINTING METHOD

CROSS REFERENCES TO RELATED APPLICATIONS

This application claims priority to Japanese Patent Application No. 2015-109079 filed on May 28, 2015. The entire disclosures of Japanese Patent Application No. 2015-109079 is hereby incorporated herein by reference.

BACKGROUND

1. Technical Field

The present invention relates to a liquid ejecting head unit provided with a liquid ejecting head which ejects a liquid from nozzles, a liquid ejecting apparatus, a wiping method of the liquid ejecting head, and a printing method.

2. Related Art

Among liquid ejecting apparatuses which eject a liquid onto an ejection target medium, for example, there is known an ink jet recording apparatus which performs printing on a recording medium (an ejection target medium) such as paper or a recording sheet by ejecting an ink as the liquid.

In an ink jet recording head in which such an ink jet recording apparatus is installed, since ink droplets are ejected from nozzles onto an ejection target medium, due to ink adhering to the vicinity of the nozzles of a liquid ejecting surface which ejects the ink droplets, or due to adhered ink solidifying, for example, there is a problem in that the ejection direction of the ink droplets is not stable, or a problem in that an ejection fault such as the ink droplets not being ejected occurs.

Therefore, ink, fluff, dust, paper dust, or the like which is adhered to the liquid ejecting surface is cleaned by wiping the liquid ejecting surface using a plate-shaped wiper which is formed of an elastic material such as rubber.

However, the viscosity of the ink which is adhered to a nozzle surface increases due to drying, and there is a concern that ejection faults will arise in the nozzles due to the increased-viscosity ink being rubbed into the nozzles by the wiper.

Therefore, a system is proposed in which, before performing the wiping using the wiper, rubbing of the viscosity-increased ink is suppressed by causing the ink to seep from the nozzles and dissolving the viscosity-increased ink using the ink which seeps out (for example, refer to JP-A-7-96604).

However, even if the inside of the nozzles is rendered a positive pressure and the entry of the viscosity-increased ink, paper dust, bubbles, or the like is prevented by wiping the nozzle surface while causing the ink to flow from the nozzle, there is a problem in that wasteful consumption of the ink increases.

These problems are present not only in an ink jet recording head unit provided with an ink jet recording head, but similarly in a liquid ejecting head unit provided with a liquid ejecting head which ejects a liquid other than an ink.

SUMMARY

An advantage of some aspects of the invention is to provide a liquid ejecting head unit, a liquid ejecting apparatus, and a wiping method which are capable of suppressing consumption of a liquid and reliably performing wiping of nozzles.

Aspect 1

According to this aspect of the invention, there is provided a liquid ejecting head unit which includes a liquid ejecting head which includes a nozzle surface which is on a plane which is defined by a first direction and a second direction and on which a plurality of nozzles are provided, two directions intersecting each other being defined as the first direction and the second direction, a wiping unit which performs relative movement in the second direction between a wiper parallel to the first direction and the nozzle surface and wipes the nozzle surface, a recessed section which is formed by a level difference which is provided along the first direction on the nozzle surface, and a control unit, in which the control unit controls the liquid ejecting head to fill the recessed section with a liquid which spills from at least one nozzle among the plurality of nozzles, and controls the wiping unit to wipe the nozzles after wiping the recessed section which is filled with the liquid using the wiper in the relative movement between the wiper and the nozzle surface, and in which in a case in which the plurality of nozzles are projected in the second direction in relation to a virtual line parallel to the first direction, an area in which the plurality of nozzles are distributed on the virtual line is included in an area in which the recessed section which is filled with the liquid is distributed on the virtual line. Or there is provided a liquid ejecting head unit which includes a liquid ejecting head which includes a nozzle surface provided with nozzles, the nozzle surface being on a plane defined by two directions including a first and a second directions intersecting each other, a wiping unit comprising a wiper parallel to the first direction and configured to perform relative movement in the second direction between the wiper and the nozzle surface to wipe the nozzle surface, a recess defined by an edge provided along the first direction on the nozzle surface, and a controller configured to control the liquid ejecting head to fill the recess with a liquid which spills from at least one nozzle among the nozzles, and control the wiping unit to wipe the nozzle surface after wiping the recess which is filled with the liquid, and wherein in a case in which the nozzles are projected in the second direction in relation to a virtual line parallel to the first direction, an area in which the nozzles are distributed on the virtual line is included in an area in which the recess which is filled with the liquid is distributed on the virtual line.

According to this aspect, by wiping the nozzles after wiping the recess which is a recess including the area in which the nozzles are provided and is filled with the liquid, it is possible to dissolve the viscosity-increased liquid which is adhered to the nozzle surface, and it is possible to suppress the rubbing of the viscosity-increased liquid into the nozzles. Since the liquid may fill only the area of the recess which is wiped by the wiper before the nozzles, it is possible to suppress the amount of wasteful consumption of the liquid.

Aspect 2

In the liquid ejecting head unit according to Aspect 1, it is preferable that the recess surrounds the plurality of nozzles on the plane which is defined by the first direction and the second direction. Accordingly, no matter which position of nozzle the liquid spills out from, it is possible to fill the level difference with the liquid.

Aspect 3

In the liquid ejecting head unit according to Aspect 1 or 2, it is preferable that the plurality of nozzles are disposed in a plurality of positions in the second direction, and that a distance in the second direction between the nozzle which is closest to the recess in the second direction and the recess is smaller than a distance in the second direction between the two nozzles which are most separated in the second direction. Accordingly, since the recess is disposed near to the nozzles, the liquid which spills out from the nozzles easily moves to the recess, and it is easy to fill the recess with the liquid.

Aspect 4

In the liquid ejecting head unit according to any one of Aspects 1 to 3, it is preferable that the recess is formed by a nozzle plate in which the plurality of nozzles are provided, a fixing plate in which a through hole surrounding the nozzle plate is provided, and a communicating plate to which the nozzle plate and the fixing plate are fixed. Accordingly, since the recess is formed using the nozzle plate, it is possible to dispose the recess and the nozzles close to each other, and it is easy to fill the recess with the liquid which spills out from the nozzles.

Aspect 5

In the liquid ejecting head unit according to Aspect 4, it is preferable that a surface of the nozzle plate to be wiped is more water repellent than the recess. Accordingly, it is easy to fill the recess with the liquid.

Aspect 6

In the liquid ejecting head unit according to any one of Aspects 1 to 5, it is preferable that the plurality of nozzles include nozzles which eject a first type of liquid, and nozzles which eject a second type of liquid which has smaller surface tension than the first type of liquid, and that the recess is filled with at least the second type of liquid. Accordingly, by causing the liquid with the low surface tension to spill from the nozzles, it is easy to break the meniscus of the nozzles, and it is possible to suppress the consumption amount of the liquid.

Aspect 7

In the liquid ejecting head unit according to any one of Aspects 1 to 6, it is preferable that the liquid ejecting head unit further includes a liquid receiving plate, and that after causing the liquid to spill from at least one nozzle among the plurality of nozzles, the recess is filled with the liquid by causing the nozzle surface and the liquid receiving plate to approach each other. Accordingly, it is possible to easily fill the recess with the liquid using the liquid receiving plate, and it is possible to suppress the amount of wasteful consumption of the liquid.

Aspect 8

In the liquid ejecting head unit according to Aspect 7, it is preferable that the liquid receiving plate includes a groove along a direction oriented from the nozzles toward the recess. Accordingly, by providing the groove, it is easy to guide the liquid along the groove to the recess, and it is possible to further suppress the wasteful consumption of the liquid.

Aspect 9

In the liquid ejecting apparatus, it is preferable that the liquid is ejected to perform printing on an ejection target medium.

Aspect 10

According to this aspect of the invention, there is provided a liquid ejecting apparatus including the liquid ejecting head unit according to any one of Aspects 1 to 9.

According to this aspect, it is possible to reliably perform the wiping of the nozzles, and it is possible to realize a liquid ejecting apparatus in which wasteful consumption of the liquid is suppressed.

Aspect 11

According to this aspect of the invention, there is provided a wiping method of wiping a nozzle surface which is on a plane which is defined by a first direction and a second direction and on which a plurality of nozzles are provided using a wiper, two directions intersecting each other being defined as the first direction and the second direction, the method including providing a recess using a level difference which is provided on the nozzle surface along the first direction in a position which is different from the plurality of nozzles in the second direction on the nozzle surface, filling the recess with a liquid which spills from at least one nozzle among the plurality of nozzles, and wiping the nozzles after wiping the recess by performing relative movement in the second direction between the wiper parallel to the first direction and the nozzle surface, in which in a case in which the plurality of nozzles are projected in the second direction in relation to a virtual line parallel to the first direction, an area in which the plurality of nozzles are distributed on the virtual line is included in an area in which the recess which is filled with the liquid is distributed on the virtual line. Or there is provided a wiping method of wiping a nozzle surface provided with nozzles, the nozzle surface being on a plane defined by two directions including a first and a second directions intersecting each other, the method comprising, providing a recess using an edge provided on the nozzle surface along the first direction in a position which is different from the nozzles in the second direction on the nozzle surface, filling the recess with a liquid which spills from at least one nozzle among the nozzles, and wiping the nozzles after wiping the recess by performing relative movement in the second direction between a wiper parallel to the first direction and the nozzle surface, wherein in a case in which the nozzles are projected in the second direction in relation to a virtual line parallel to the first direction, an area in which the nozzles are distributed on the virtual line is included in an area in which the recess which is filled with the liquid is distributed on the virtual line.

According to this aspect, by wiping the nozzles after wiping the recess which is a recess including the area in which the nozzles are provided and is filled with the liquid, it is possible to dissolve the viscosity-increased liquid which is adhered to the nozzle surface, and it is possible to suppress the rubbing of the viscosity-increased liquid into the nozzles. Since the liquid may fill only the area of the recess which is wiped by the wiper before the nozzles, it is possible to suppress the amount of wasteful consumption of the liquid.

Aspect 12

In the wiping method according to Aspect 11, it is preferable that the recess surrounds the plurality of nozzles on the plane which is defined by the first direction and the second direction. Accordingly, no matter which position of nozzle the liquid spills out from, it is possible to fill the level difference with the liquid.

Aspect 13

In the wiping method according to Aspect 11 or 12, it is preferable that the plurality of nozzles are disposed in a plurality of positions in the second direction, and that a distance in the second direction between the nozzle which is closest to the recess in the second direction and the recess is smaller than a distance in the second direction between the two nozzles which are most separated in the second direction. Accordingly, since the recess is disposed near to the nozzles, the liquid which spills out from the nozzles easily moves to the recess, and it is easy to fill the recess with the liquid.

Aspect 14

In the wiping method according to any one of Aspects 11 to 13, it is preferable that the recess is formed by a nozzle plate in which the plurality of nozzles are provided, a fixing plate in which a through hole surrounding the nozzle plate is provided, and a communicating plate to which the nozzle plate and the fixing plate are fixed. Accordingly, since the recess is formed using the nozzle plate, it is possible to dispose the recess and the nozzles close to each other, and it is easy to fill the recess with the liquid which spills out from the nozzles.

Aspect 15

In the wiping method according to Aspect 14, it is preferable that a surface of the nozzle plate to be wiped is more water repellent than the recess. Accordingly, it is easy to fill the recess with the liquid.

Aspect 16

In the wiping method according to any one of Aspects 11 to 15, it is preferable that the plurality of nozzles include nozzles which eject a first type of liquid, and nozzles which eject a second type of liquid which has smaller surface tension than the first type of liquid, and that the recess is filled with at least the second type of liquid. Accordingly, by causing the liquid with the low surface tension to spill from the nozzles, it is easy to break the meniscus of the nozzles, and it is possible to suppress the consumption amount of the liquid.

Aspect 17

According to this aspect of the invention, there is provided a printing method, in which a nozzle surface in which a plurality of nozzles are formed is wiped by the wiper using the wiping method according to any one of Aspects 11 to 16, and in which the liquid is ejected to perform printing on an ejection target medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, detailed description will be given of the embodiments of the invention.

First Embodiment

Figure 1:
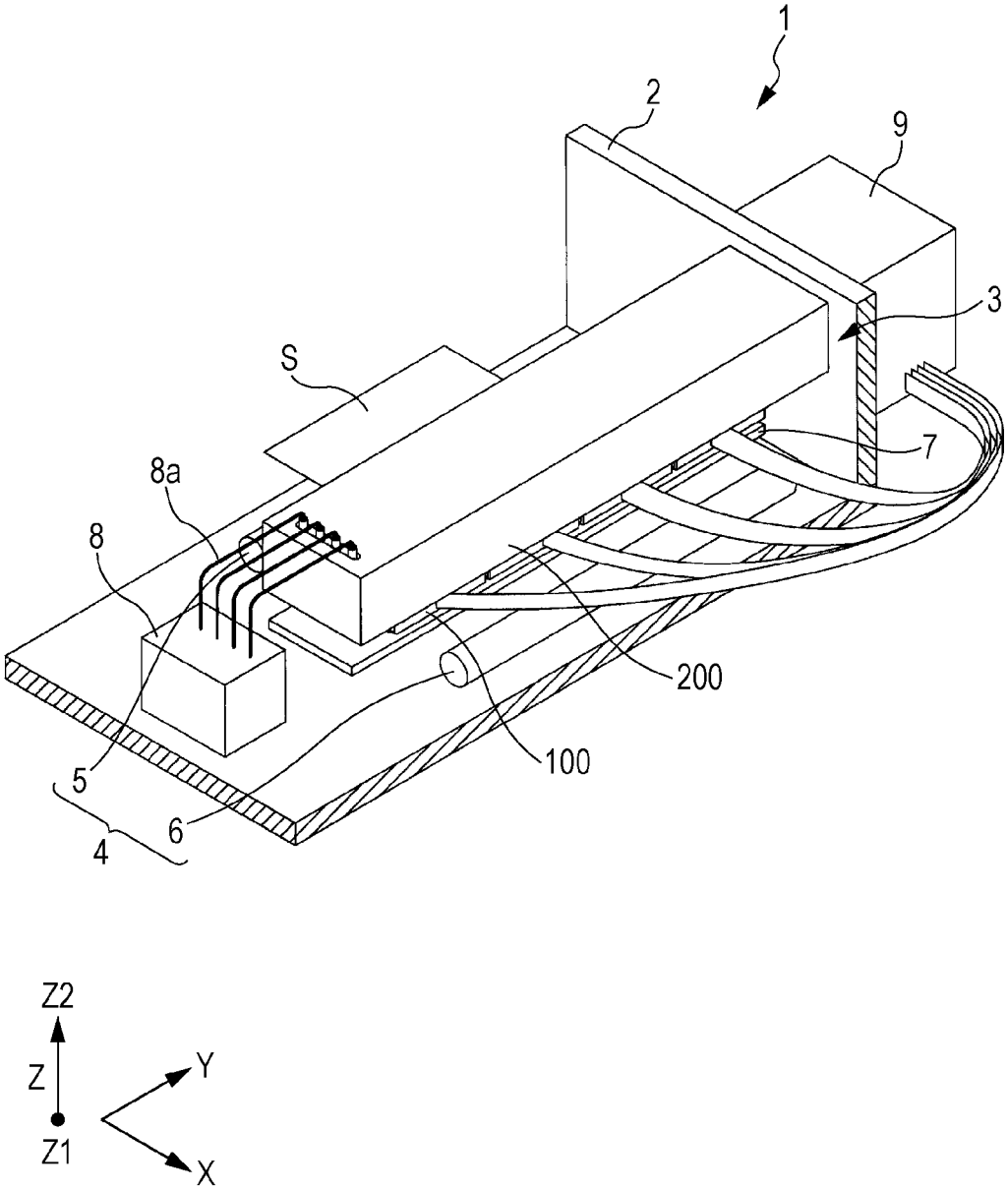
FIG. 1 is a schematic perspective diagram of a recording apparatus according to a first embodiment of the invention.

FIG. 1 is a perspective diagram illustrating the schematic configuration of an ink jet recording apparatus, which is an example of the liquid ejecting apparatus according to the first embodiment of the invention.

The ink jet recording apparatus which is an example of the liquid ejecting apparatus of the present embodiment is a so-called line-type recording apparatus in which an ink jet recording head module including an ink jet recording head, which is an example of the liquid ejecting head, is fixed to the apparatus main body, and performs printing by transporting a recording sheet S such as paper which is an ejection target medium.

Specifically, as illustrated in FIG. 1, an ink jet recording apparatus 1 is provided with an apparatus main body 2, an ink jet recording head 3 (hereinafter also simply referred to as the recording head 3) which is provided with a plurality of head main bodies 100 and is fixed to the apparatus main body 2, a transport unit 4 which transports the recording sheet S, a support member 7 which supports the recording sheet S mutually facing the recording head 3, a liquid supply unit 8 which supplies an ink which is a liquid to the recording head 3, a control device 9 which is the controller, and a wiping unit (not illustrated). In the present embodiment, the transport direction of the recording sheet S will be referred to as a first reference direction X. A direction which orthogonally intersects the first reference direction X in an in-plane direction in which the nozzles of the recording head 3 are opened will be referred to as a second reference direction Y. A direction which orthogonally intersects the first reference direction X and the second reference direction Y will be referred to as a third reference direction Z. A liquid ejecting direction side (the recording sheet S side) in the plane including the third reference direction Z will be referred to as a Z1 side, and the opposite side as a Z2 side.

The recording head 3 is provided with the plurality of head main bodies 100, and a holding member 200 which holds the plurality of head main bodies 100.

The plurality of head main bodies 100 are provided to line up in a direction intersecting the first reference direction X which is the transport direction, in the present embodiment, the second reference direction Y which orthogonally intersects the first reference direction X, and are fixed to the holding member 200. In the present embodiment, the plurality of head main bodies 100 are provided to line up on a straight line in the second reference direction Y. In other words, the plurality of head main bodies 100 are not disposed shifted in the first reference direction X. Accordingly, it is possible to obtain a reduction in size by narrowing the width of the recording head 3 in the first direction.

The holding member 200 holds the plurality of head main bodies 100 such that the nozzles of the plurality of head main bodies 100 face the recording sheet S side. In the present embodiment, although described in detail later, flow paths which supply the ink to the head main bodies 100, a pressure adjustment unit which adjusts the pressure, a valve which opens and closes the flow paths, a pressurizing unit which pressurizes the ink, and the like are provided in the holding member 200. In other words, in the present embodiment, the holding member 200 also functions as a flow path member which forms the flow paths. Naturally, a configuration may be adopted in which the holding member 200 only performs the holding of the head main bodies 100 and a flow path member or the like which includes the flow paths is further provided in the holding member 200. The plurality of head main bodies 100 for which the holding member 200 is integrated are fixed to the apparatus main body 2.

The transport unit 4 transports the recording sheet S in the first reference direction X in relation to the recording head 3. For example, the transport unit 4 is provided with a first transport roller 5 and a second transport roller 6 which are provided on both sides of the first reference direction X which is the transport direction of the recording sheet S in relation to the recording head 3.

The recording sheet S is transported by the first transport roller 5 and the second transport roller 6. The transport unit 4 which transports the recording sheet S is not limited to being a transport roller, and may be a belt, a drum, or the like.

The support member 7 supports the recording sheet S which is transported by the transport unit 4 at a position at which the recording sheet S mutually faces the recording head 3. For example, the support member 7 is formed of metal, resin, or the like which has a rectangular sectional shape which is provided between the first transport roller 5 and the second transport roller 6 to mutually face the recording head 3.

An adhesion unit which adheres the recording sheet S which is transported onto the support member 7 is provided in the support member 7. Examples of the adhesion unit include an adhesion unit which adheres the recording sheet S using vacuum suction, an adhesion unit which adheres the recording sheet S using static electricity, and the like. For example, in a case in which the transport unit 4 is a belt or a drum, the support member 7 supports the recording sheet on the belt or on the drum at a position at which the recording sheet S mutually faces the recording head 3.

The liquid supply unit 8 which includes a liquid storage unit such as an ink tank in which the ink is stored is connected to each of the head main bodies 100 of the recording head 3 to be capable of supplying the ink. In the present embodiment, the liquid supply unit 8 is fixed to the apparatus main body 2 which is different from the recording head 3, and the ink from the liquid supply unit 8 is supplied to the recording head 3 via supply tubes 8*a*. The ink from the liquid supply unit 8 may be directly supplied to the head main bodies 100 without going via the holding member 200, the flow path member, or the like. The liquid supply unit 8 is not limited to being fixed to a position which is different from the recording head 3, and, for example, a liquid supply unit such as an ink cartridge may be held on the recording head 3 and the ink may be directly supplied from the liquid supply unit to the holding member 200, the flow path member, the recording head, or the like.

In the ink jet recording apparatus 1, the recording sheet S is transported by the first transport roller 5, and printing is executed by the recording head 3 on the recording sheet S which is supported on the support member 7. The recording sheet S which is printed on is transported by the second transport roller 6. In a case in which the wiping unit (not illustrated) wipes the nozzle surfaces of the head main bodies 100, the wiping is performed by the wiping unit moving to a position at which the wiping unit mutually faces the nozzle surfaces of the head main bodies 100, or, by the recording head 3 moving to a position at which the wiping unit is provided, or the like.

Figure 2:
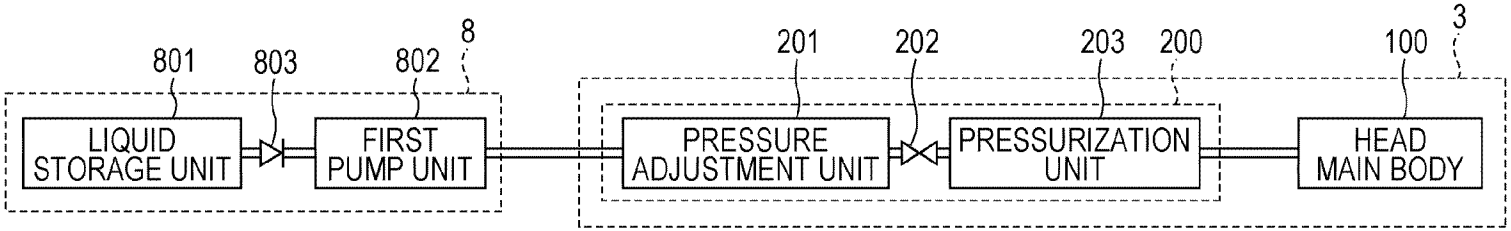
FIG. 2 is a block diagram illustrating a flow path configuration of the recording apparatus according to the first embodiment of the invention.

Here, description will be given of the flow path configuration of the ink jet recording apparatus 1 of the present embodiment, with reference to FIG. 2. FIG. 2 is a block diagram illustrating the flow path configuration of the ink jet recording apparatus of the present embodiment.

As illustrated in FIG. 2, in the ink jet recording apparatus 1 described above, the ink from the liquid supply unit 8 is supplied to the recording head 3 via the supply tubes 8*a*.

Here, the liquid supply unit 8 is provided with a liquid storage unit 801 such as an ink tank which stored the ink which is a liquid, a first pump unit 802 which pumps the ink of the liquid storage unit 801 toward the recording head 3, and a check valve 803 which is provided between the first pump unit 802 and the liquid storage unit 801 and suppresses back-flowing of the ink from the first pump unit 802.

The first pump unit 802 supplies the ink which is stored in the liquid storage unit 801 to the recording head 3 while not allowing the ink to flow backward using the check valve 803. Examples of the first pump unit 802 include a pressing unit which presses the liquid storage unit 801 from outside, a pressurizing pump, and the like. A head pressure difference which is generated by adjusting the relative position of the recording head 3 and the liquid storage unit 801 in the vertical direction may be used as the first pump unit 802.

The recording head 3 is provided with the plurality of head main bodies 100, and the holding member 200 which holds the plurality of head main bodies 100. A flow path which supplies the ink from the liquid supply unit 8 to the head main body 100 is provided in the holding member 200, and a pressure adjustment unit 201 which adjusts the pressure of the ink which is supplied from the liquid supply unit 8, a valve 202 which is provided on the head main body 100 side which is further downstream than the pressure adjustment unit 201 and which opens and closes the flow path, and a pressurization unit 203 which is provided closer to the downstream side than the valve 202 are provided in the middle of the flow path.

While detailed description will be given later, the pressure adjustment unit 201 is formed of a pressure adjustment valve which is opened by the flow path of the downstream side assuming a negative pressure. By providing the pressure adjustment unit 201, it is possible to suppress the leaking of the ink from the nozzles of the head main body 100 by suppressing the constant supplying of the ink which is pumped to the head main body 100 by the first pump unit 802 to the head main body 100.

The pressurization unit 203 pressurizes the ink within the flow path at a desired timing. The valve 202 suppresses the back-flowing of the ink to the pressure adjustment unit 201 side which is the upstream side by closing the valve in the flow path during the pressurization of the pressurization unit 203, and ensures that the ink which is pressurized by the pressurization unit 203 is supplied to the head main body 100. Incidentally, although detailed description will be given later, since a portion of the pressure adjustment unit 201 is formed of a flexible film, when the ink flows back to the pressure adjustment unit 201 side during the pressurization of the ink by the pressurization unit 203, the pressure of the pressurization unit 203 is absorbed by the film of the pressure adjustment unit 201 flexibly deforming. Therefore, when the pressurization unit 203 pressurizes the ink, by closing the valve 202, it is possible to suppress the pressure absorption caused by the deformation of the film of the pressure adjustment unit 201 and to efficiently supply the pressurized ink to the head main body 100.

Figure 3:
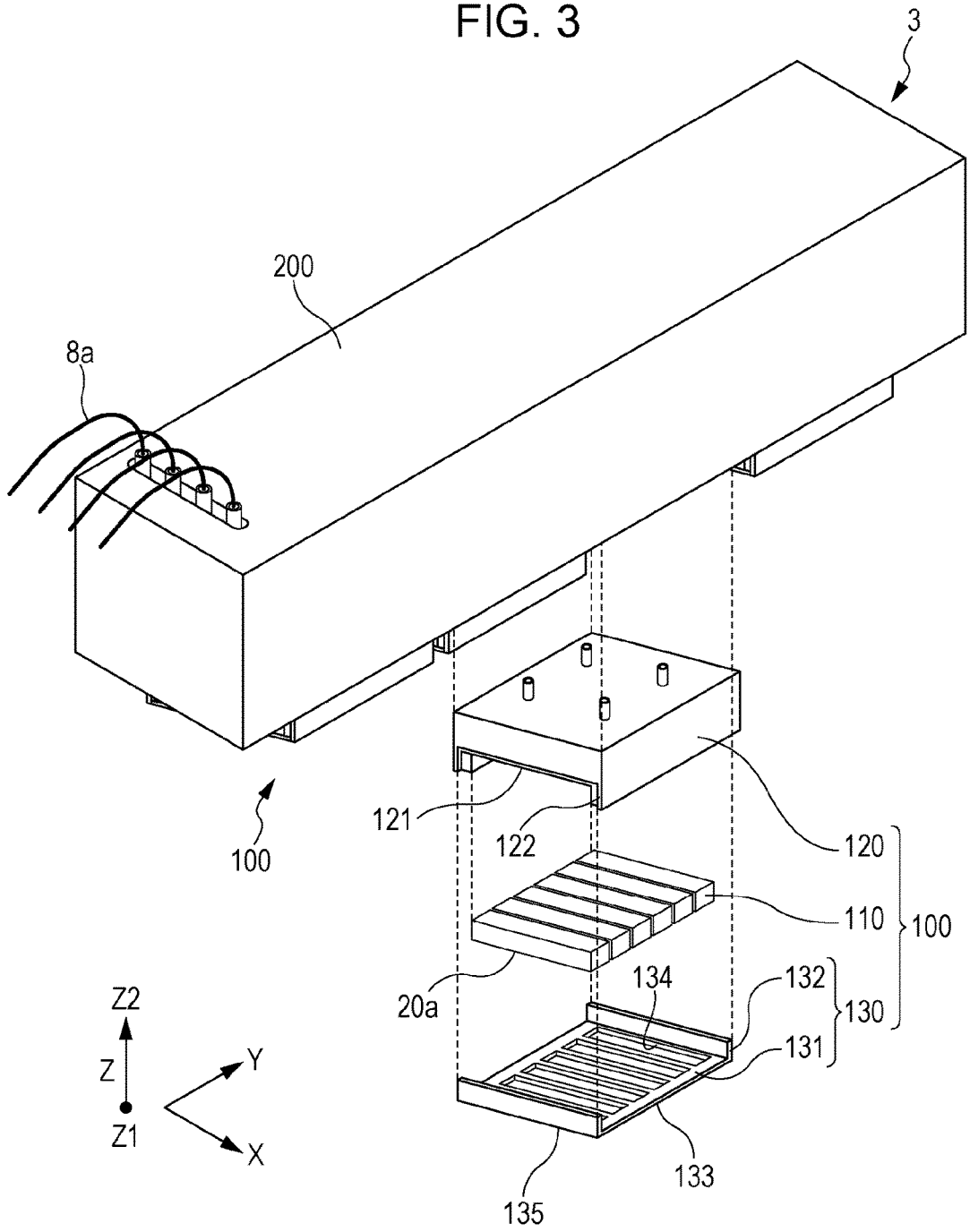
FIG. 3 is an exploded perspective diagram of a head module according to the first embodiment of the invention.
Figure 4:
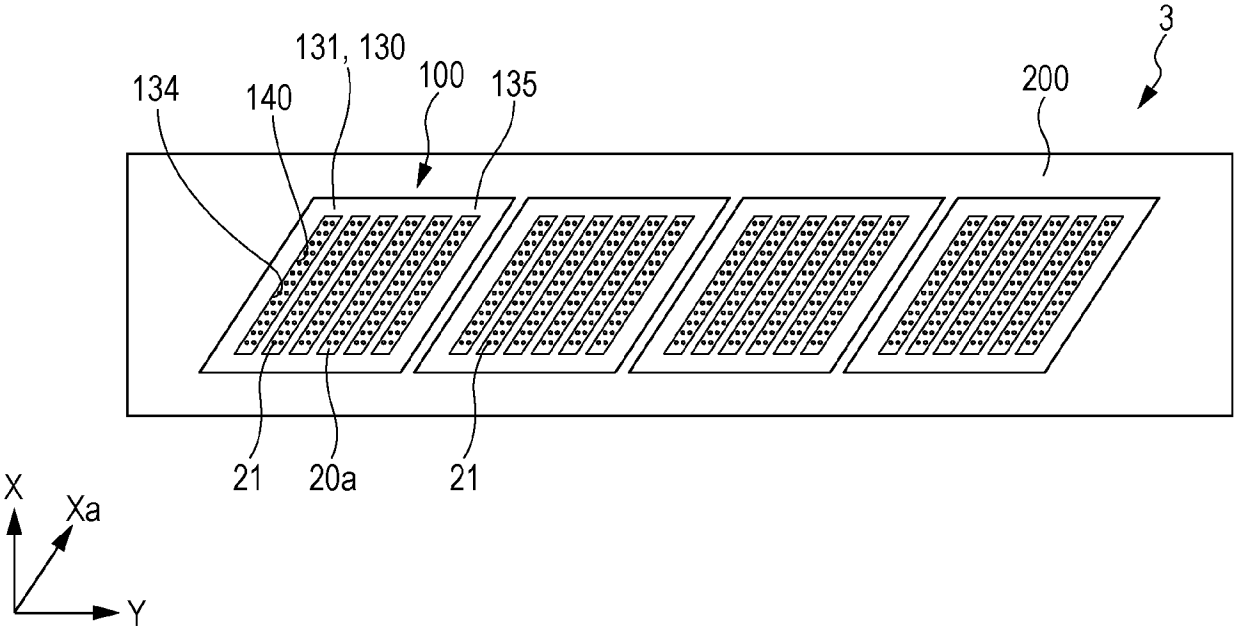
FIG. 4 is a plan diagram of the head module according to the first embodiment of the invention.

Here, more detailed description will be given of the recording head 3 of the present embodiment, with reference to FIGS. 3 and 4. FIG. 3 is an exploded perspective diagram of the head module according to the first embodiment of the invention, and FIG. 4 is a plan diagram of the nozzle surface side of the head module.

As depicted in the drawings, the recording head 3 of the present embodiment is provided with the plurality of head main bodies 100, and the holding member 200 which holds the plurality of head main bodies 100.

The head main body 100 includes a nozzle surface in which nozzles 21 are provided on the Z1 side of the third reference direction Z. The head main body 100 is fixed to the surface of the side of the holding member 200 which mutually faces the recording sheet S, that is, is fixed to the Z1 side, which is the recording sheet S side in the third reference direction Z. The plurality of head main bodies 100 are fixed to the holding member 200 by being provided lined up on a straight line in the second reference direction Y which orthogonally intersects the first reference direction X which is the transport direction of the recording sheet S. In other words, the plurality of head main bodies 100 are not disposed shifted in the first reference direction X. Accordingly, it is possible to obtain a reduction in the size of the recording head 3 by narrowing the width of the recording head 3 in the first reference direction X. Naturally, the head main bodies 100 which are provided to line up in the second reference direction Y may be disposed shifted in the first reference direction X; however, when the head main bodies 100 are greatly shifted in the first reference direction X, the width of the holding member 200 and the like in the first reference direction X increases. When the width of the recording head 3 in the first reference direction X increases, the distance between the first transport roller 5 and the second transport roller 6 in the first reference direction X in the ink jet recording apparatus 1 is increased, and it becomes difficult to fix the orientation of the recording sheet S. The recording head 3 and the ink jet recording apparatus 1 increase in size. In the present embodiment, by narrowing the width of the recording head 3 in the first reference direction X, the distance between the first transport roller 5 and the second transport roller 6 in the first reference direction X is shortened, it is possible to simplify the fixing of the orientation of the recording sheet S, and it is possible to reduce the size of the ink jet recording apparatus 1.

In the present embodiment, four of the head main bodies 100 are fixed to the holding member 200; however, the number of head main bodies 100 may be one, and may be a plurality of two or more.

Here, more detailed description will be given of an example of the head main body 100 which is installed in the recording head 3.

As illustrated in FIGS. 3 and 4, the head main body 100 of the present embodiment is provided with a plurality of head chips 110, a holder 120 which holds the plurality of head chips 110, and a cover 130 which is a fixing plate which is provided on a first nozzle surface 20*a* side of the head chips 110.

The first nozzle surface 20*a* in which the nozzles 21 are provided is included on the Z1 side of the head chip 110 in the third reference direction Z. The Z2 side of the plurality of head chips 110 is adhered to the surface of the Z1 side of the holder 120.

The holder 120 includes a holding section 121 which forms a groove-shaped space in the Z1 side. The holding section 121 is provided to be open in both side surface of the second reference direction Y by being provided continuously along the second reference direction Y in the surface of the Z1 side of the holder 120. Leg sections 122 are formed on both sides of the holding section 121 of the holder 120 in the first reference direction X.

The plurality of head chips 110 are fixed inside the holding section 121 by being fixed using an adhesive or the like. Flow paths and the like which supply the ink to the head chips 110 are provided on the inner portion (not illustrated) of the holder 120. The holder 120 may be formed by laminating a plurality of members in the third reference direction Z.

The plurality of head chips 110 are adhered within the holding section 121 of the holder 120 to be provided lined up in the second reference direction Y. In the present embodiment, six of the head chips 110 are adhered to the single holder 120. Naturally, the number of the head chips 110 to fix to the single holder 120 is not particularly limited thereto, and one or a plurality of two or more of the head chips 110 may be fixed to the single holder 120. Incidentally, by providing the plurality of head chips 110 in relation to the single head main body 100 to obtain an increase in the number of nozzle rows, it is possible to improve the yield rate in comparison to a case in which the number of nozzle rows is increased by providing a plurality of nozzle rows in only the single head chip 110 in relation to the single head main body 100.

The plurality of head chips 110 of the present embodiment are fixed in the in-plane direction of the first nozzle surfaces 20*a* such that the nozzle rows are inclined in relation to the first reference direction X which is the transport direction of the recording sheet S. In other words, a fourth reference direction Xa which is the direction in which the nozzles 21 which form the nozzle rows are lined up is a direction which is inclined in relation to the first reference direction X. In other words, the plurality of nozzles 21 are distributed along the fourth reference direction Xa on a plane that is defined by the fourth reference direction Xa and the second reference direction Y which intersects the fourth reference direction Xa. Therefore, in the present embodiment, the fourth reference direction Xa corresponds to a first direction, and the second reference direction Y corresponds to a second direction. The plane that is defined by the fourth reference direction Xa and the second reference direction Y will be referred to as the first nozzle surface 20*a*. In the present embodiment, in the head main body 100, the plurality of head chips 110 are provided to line up in the second reference direction Y, and it is possible to dispose at least a portion of the nozzles 21 of the head chips 110 which are adjacent in the second reference direction Y in positions at which the portion of the nozzles 21 overlap each other in the first reference direction X. Accordingly, it is possible to form the nozzles 21 which are provided to line up along the second reference direction Y of the recording head 3 at a similar interval.

The cover 130 corresponds to a fixing plate, and is formed of a plate shaped member of metal or the like. The cover 130 is provided on the first nozzle surface 20*a* side of the head main bodies 100, that is, the Z1 side of the head main bodies 100 in the third reference direction Z.

The cover 130 is formed by bending a plate-shaped member, and is provided with a base section 131 which is provided on the first nozzle surface 20*a* side, and folded sections 132 which are provided by folding both end portions of the base section 131 in the second reference direction Y to the Z2 side in the third reference direction Z.

As illustrated in FIG. 3, the base section 131 is bonded to the surface of the Z1 side of the holder 120 in the third reference direction Z, that is, the end surfaces of the Z1 side of the leg sections 122 via an adhesive.

Exposed opening sections 134 which are through holes for exposing the nozzles 21 of each of the head chips 110 are provided in the base section 131. In the present embodiment, the exposed opening sections 134 are provided to be independently open for each of the head chips 110. In other words, since the head main body 100 of the present embodiment includes six of the head chips 110, six independent exposed opening sections 134 are provided in the base section 131. Naturally, depending on the configuration and the like of the head chips 110, a single common exposed opening section 134 may be provided for a head main body group which is formed of a plurality of the head chips 110. The Z1 side of the holding section 121 of the holder 120 is covered by the base section 131. In the present embodiment, the Z1 side surface of the base section 131 will be referred to as a second nozzle surface 135. In other words, the nozzle surface of the head main body 100 includes the first nozzle surfaces 20*a* of the head chips 110 and the second nozzle surface 135 of the cover 130.

The folded sections 132 are provided on both end portions of the base section 131 in the second reference direction Y, and are formed at a size to cover the opening areas of the holding section 121 which are opened in the side surfaces in the second reference direction Y thereof. The folded sections 132 are bonded to the side surfaces of the holder 120 in the second reference direction Y via an adhesive. Accordingly, the openings in the side surfaces of the holding section 121 in the second reference direction Y are covered and sealed by the folded section 132.

In other words, between the holder 120 and the cover 130, by the end surfaces of the leg sections 122 in the third reference direction Z being adhered to the base section 131 using adhesive at both sides in the first reference direction X, and the side surfaces in which the holding section 121 is open being adhered to the folded sections 132 using adhesive at both sides in the second reference direction Y, the head chips 110 are disposed within the holding section 121 which is the space between the holder 120 and the cover 130.

In this manner, in the present embodiment, since the cover 130 is adhered to the holder 120 by providing the folded sections 132 on the cover 130 at both sides of the holder 120 in the second reference direction Y, leg sections for adhering the holder 120 to the base section 131 of the cover 130 on both sides of the holder 120 in the second reference direction Y become unnecessary. Therefore, since there are no leg sections on the sides between the head main bodies 100 which are adjacent to each other when the head main bodies 100 are provided to line up in the second reference direction Y, it is possible to narrow the interval between the adjacent head main bodies 100 in the second reference direction Y. Accordingly, it is possible to provide the head chips 110 of the head main bodies 100 which are adjacent in the second reference direction Y close to each other, it is possible to provide the nozzles 21 which are provided in each of the head chips 110 of the adjacent ink jet recording heads close to each other in the second reference direction Y, and it is possible to dispose the nozzles 21 of the head main bodies 100 which are adjacent in the second reference direction Y close to each other in positions which overlap in the first reference direction X. Therefore, it is possible to provide the plurality of head main bodies 100 to line up on a straight line extending in the second reference direction Y, and it is possible to reduce the width of the recording head 3 in the first reference direction X.

As illustrated in FIG. 4, the head main body 100 of the present embodiment has a substantially parallelogram shape when viewed in plan view from the nozzle surface side. As described above, this is because the fourth reference direction Xa, which is the direction in which the nozzles 21 which form the nozzle rows of each of the head chips 110 are lined up, is provided to be inclined in relation to the first reference direction X which is the transport direction of the recording sheet S, and the external shape of the head main body 100 is formed to be a substantial parallelogram shape inclined in the same manner as the fourth reference direction Xa which is the direction in which the nozzle rows are inclined. Naturally, the shape of the head main body 100 when viewed in plan view from the first nozzle surface 20*a* side is not limited to a parallelogram shape, and may be rectangular, trapezoidal, polygonal, or the like.

By providing the plurality of head main bodies 100 to form the recording head 3, effects such as improvements to the yield rate in manufacturing, the workability, the ease of leveling the surface of the cover 130 which is the fixing plate, and the like are obtained.

Figure 5:
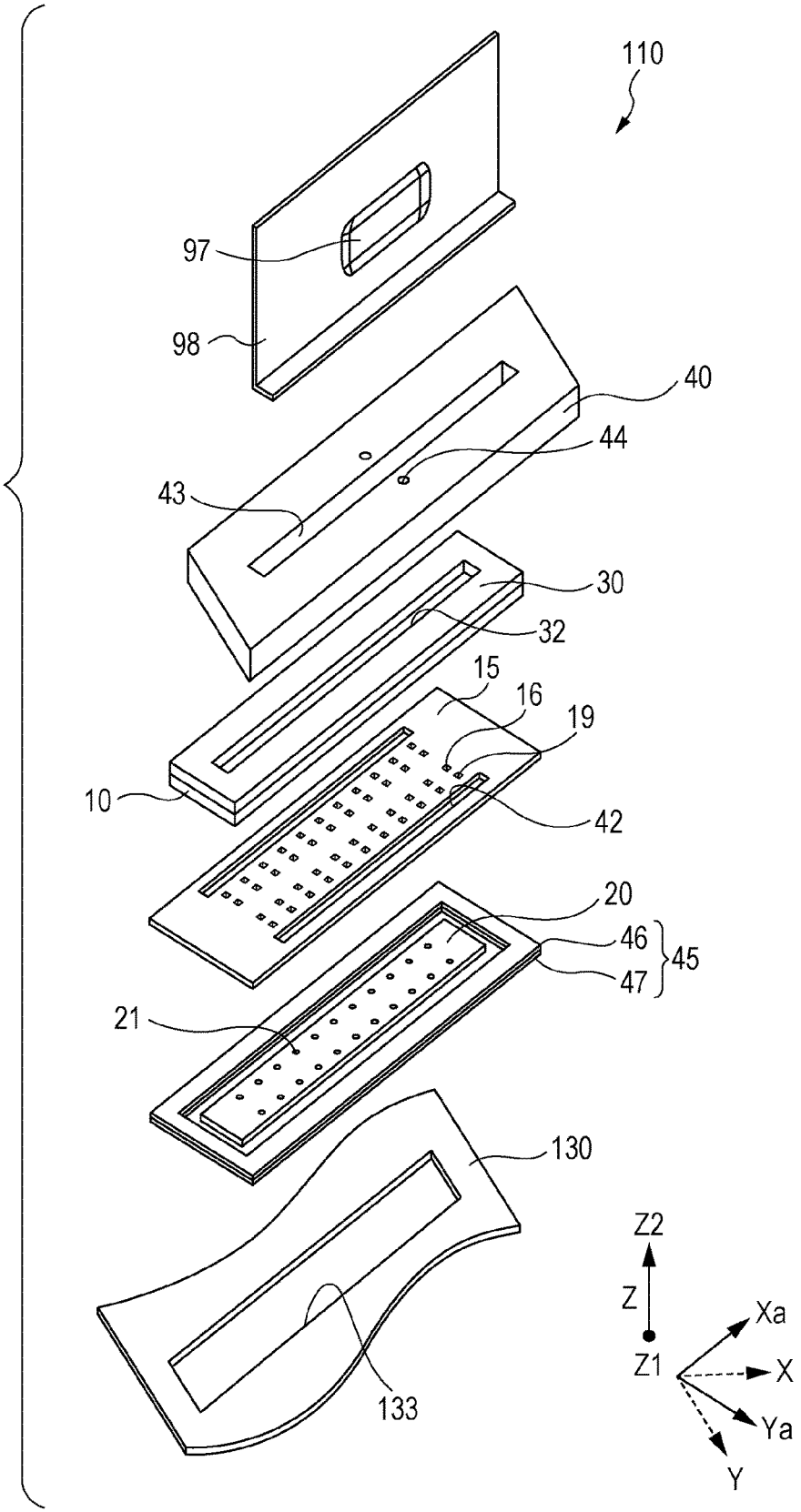
FIG. 5 is an exploded perspective diagram of a head main body according to the first embodiment of the invention.
Figure 6:
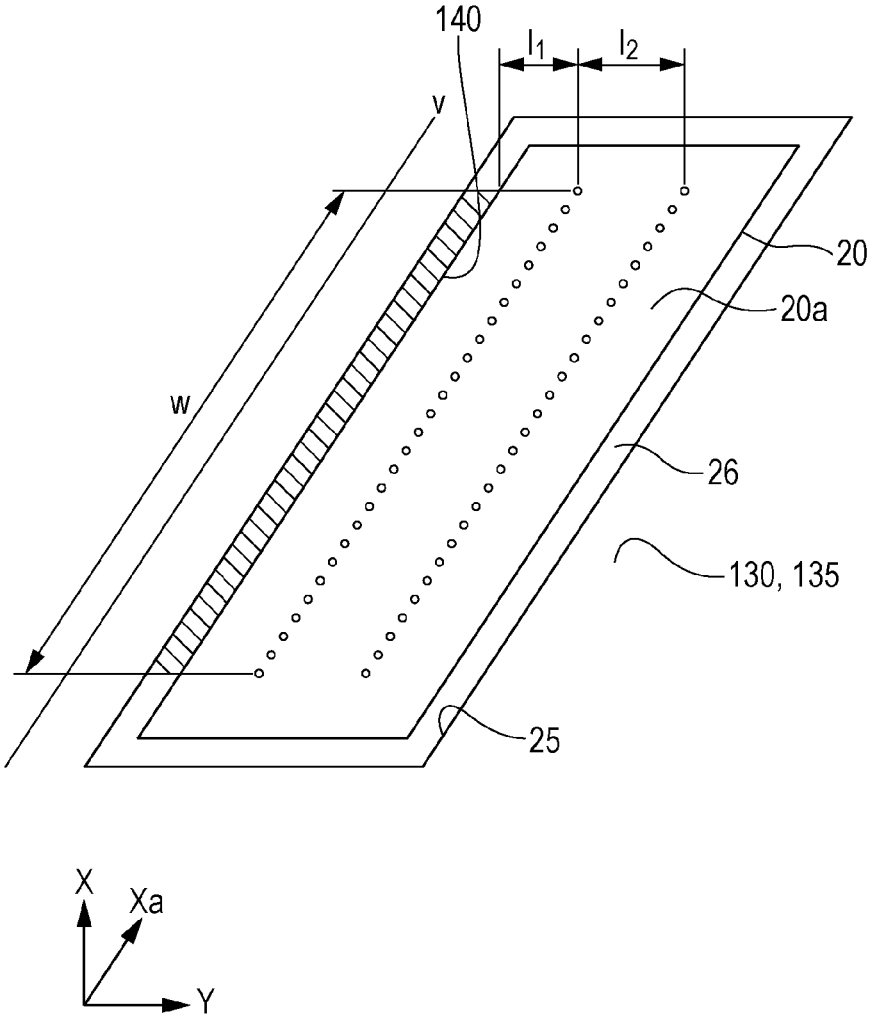
FIG. 6 is a plan diagram of the head main body and a cover according to the first embodiment of the invention.
Figure 7:
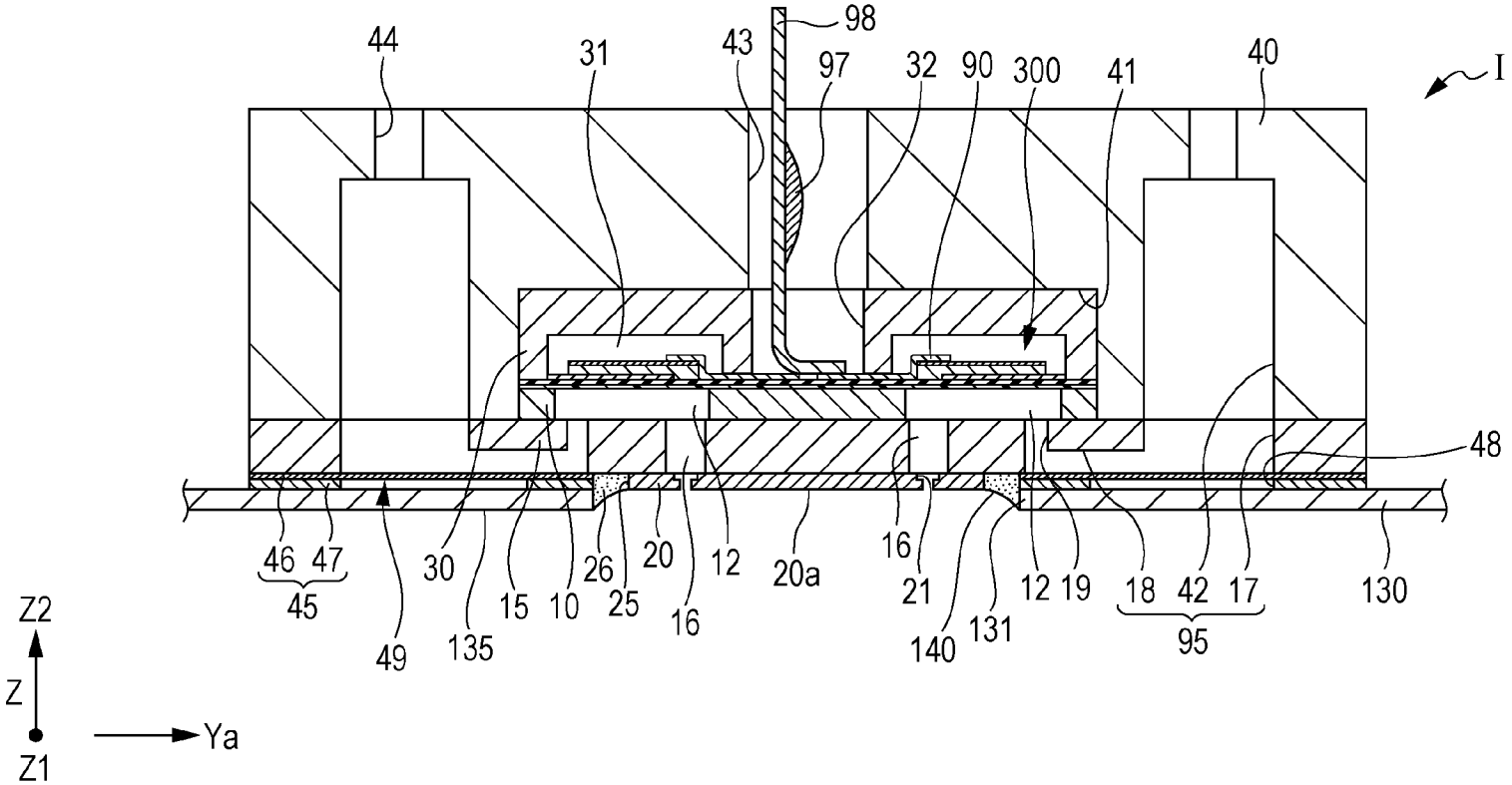
FIG. 7 is a sectional diagram of the head main body according to the first embodiment of the invention.

Hereinafter, further description will be given of an example of the head chip 110 of the head main body 100 with reference to FIGS. 5 to 7. FIG. 5 is an exploded perspective diagram of the head main body according to the first embodiment of the invention, FIG. 6 is a plan diagram of the main parts of the head main body and the cover, and FIG. 7 is a sectional diagram of the head main body in the second reference direction Y.

As illustrated in the drawings, the head chip 110 of the present embodiment is provided with a plurality of members such as a flow path forming substrate 10, a communicating plate 15, a nozzle plate 20, a protective substrate 30, a compliance substrate 45, and a case 40, the plurality of members being bonded together using an adhesive or the like.

As illustrated in the drawings, pressure generating chambers 12 which are partitioned by a plurality of partition walls are provided to line up along a direction in which the plurality of nozzles 21 are lined up in the flow path forming substrate 10 which forms the head chip 110 using anisotropic etching from one surface side. In the present embodiment, the direction in which the pressure generating chambers 12 are provided to line up matches the fourth reference direction Xa. A plurality of rows, in the present embodiment, two rows of the pressure generating chambers 12 are provided to line up in the fourth reference direction Xa on the flow path forming substrate 10. The direction in which the plurality of rows of the pressure generating chambers 12 which are formed along the fourth reference direction Xa are provided to line up will hereinafter be referred to as a fifth reference direction Ya. In the present embodiment, a direction which orthogonally intersects the fourth reference direction Xa and the fifth reference direction Ya matches the third reference direction Z. The head chip 110 of the present embodiment is installed in the recording head 3 such that the fourth reference direction Xa which is the direction in which the nozzles 21 are lined up is inclined in relation to the first reference direction X which is the transport direction of the recording sheet S.

A supply path may be provided on one end side of the pressure generating chamber 12 in the fifth reference direction Ya, in the flow path forming substrate 10. The supply path has a narrower opening area then the pressure generating chamber 12 and applies a flow path resistance to the ink that flows into the pressure generating chamber 12.

As illustrated in FIG. 5, the communicating plate 15 is bonded to one surface side of the flow path forming substrate 10. The nozzle plate 20 in which the plurality of nozzles 21 which communicate with each of the pressure generating chambers 12 are provided is bonded to the communicating plate 15. In the present embodiment, the Z1 side of the nozzle plate 20 which is the one side of the nozzle plate 20 in the third reference direction Z in which the nozzles 21 are open is the first nozzle surface 20*a*.

Nozzle communicating paths 16 that communicate the pressure generating chambers 12 with the nozzles 21 are provided in the communicating plate 15. The communicating plate 15 has a larger area than the flow path forming substrate 10, and the nozzle plate 20 has a smaller area than the flow path forming substrate 10. By setting the area of the nozzle plate 20 to be comparatively small in this manner, it is possible to achieve cost reductions.

The communicating plate 15 is provided with a first manifold section 17 and a second manifold section 18 which form a portion of a manifold 95.

The first manifold section 17 is provided to perforate the communicating plate 15 in the third reference direction Z. The second manifold section 18 is provided to part way down the third reference direction Z to be open to the nozzle plate 20 side of the communicating plate 15 without perforating the communicating plate 15 in the third reference direction Z.

The communicating plate 15 is provided with a supply communicating path 19 which communicates with one end portion of the pressure generating chamber 12 in the second reference direction Y independently for each of the pressure generating chambers 12. The supply communicating path 19 communicates the second manifold section 18 and the pressure generating chamber 12.

The nozzles 21 which communicate with each of the pressure generating chambers 12 via the nozzle communicating path 16 are formed in the nozzle plate 20. In other words, the nozzles 21 which eject the same type of ink which is the liquid are provided to line up in the fourth reference direction Xa, and two rows of the nozzles 21 which are provided to line up in the fourth reference direction Xa are formed in the fifth reference direction Ya.

Meanwhile, a diaphragm is formed on the opposite surface side of the flow path forming substrate 10 from the communicating plate 15. A piezoelectric actuator 300 which is the pressure generation unit of the present embodiment is formed by sequentially laminating a first electrode, a piezoelectric layer, and a second electrode on the diaphragm. Generally, one of the electrodes in the piezoelectric actuator 300 is a common electrode, and the other electrode and the piezoelectric layer are patterned for each of the pressure generating chambers 12.

The protective substrate 30 which is approximately the same size as the flow path forming substrate 10 is bonded to the surface of the piezoelectric actuator 300 side of the flow path forming substrate 10. The protective substrate 30 includes a holding section 31 which is a space for protecting the piezoelectric actuator 300. A through hole 32 is provided in the protective substrate 30 to perforate the protective substrate 30 in the third reference direction Z. An end portion of a lead electrode 90 which is drawn out from the electrode of the piezoelectric actuator 300 is provided to extend so as to be exposed within the through hole 32, within which the lead electrode and a wiring substrate 98 are electrically connected. A drive circuit 97 such as a drive IC is installed on the wiring substrate 98.

The case 40 which partitions the manifold 95 which communicates with the plurality of pressure generating chambers 12 is fixed to the protective substrate 30 and the communicating plate 15. The case 40 is substantially the same shape as the communicating plate 15 described above in plan view, is bonded to the protective substrate 30, and is also bonded to the communicating plate 15 described above. Specifically, the case 40 includes a recess 41 on the protective substrate 30 side. The recess 41 has a depth in which the flow path forming substrate 10 and the protective substrate 30 are housed. The recess 41 has a wider opening area than the surface of the protective substrate 30 that is joined to the flow path forming substrate 10. The opening surface of the nozzle plate 20 side of the recess 41 is sealed by the communicating plate 15 in a state in which the flow path forming substrate 10 and the like are housed in the recess 41. Accordingly, a third manifold section 42 is formed in the peripheral portion of the flow path forming substrate 10 by being partitioned by the case 40, the flow path forming substrate 10, and the protective substrate 30. The manifold 95 of the present embodiment is formed of the third manifold section 42, and the first manifold section 17 and the second manifold section 18 which are provided in the communicating plate 15.

The compliance substrate 45 is provided on the surface of the communicating plate 15 to which the first manifold section 17 and the second manifold section 18 are open. The compliance substrate 45 seals the opening of the first manifold section 17 and the second manifold section 18.

The compliance substrate 45 includes a sealing film 46 and a fixing substrate 47 in the present embodiment. The sealing film 46 is formed of a flexible thin film (for example, polyphenylene sulfide (PPS) or stainless steel (SUS)) or the like. The fixing substrate 47 is formed of a hard material such as a metal such as stainless steel (SUS). Since the region of the fixing substrate 47 opposing the manifold 95 forms an opening section 48 that is fully removed in the thickness direction, one surface of the manifold 95 forms a compliance section 49 which is a flexible section that is sealed only by the flexible sealing film 46.

The cover 130 which is a fixing plate is bonded to the opposite surface side of the compliance substrate 45 from the communicating plate 15, that is, is bonded to the Z1 side surface. In other words, the exposed opening section 134 which is a through hole provided in the base section 131 of the cover 130 has a wider opening area than the area of the nozzle plate 20, and exposes the first nozzle surface 20*a* of the nozzle plate 20 on the inside of the exposed opening section 134. Naturally, the cover 130 is not limited thereto, and, for example, a configuration may be adopted in which the exposed opening section 134 of the cover 130 is set to have a smaller opening area than the external shape of the nozzle plate 20, and the cover 130 abuts on or is adhered to the first nozzle surface 20*a* of the nozzle plate 20. Naturally, even in a case in which the exposed opening section 134 of the cover 130 is set to have a smaller opening area than the external shape of the nozzle plate 20, the cover 130 may be provided so as not to contact the first nozzle surface 20*a*. The nozzle plate 20 and the cover 130 are fixed to the communicating plate 15. The cover 130 of the present embodiment is fixed to the communicating plate 15 via the compliance substrate 45. Therefore, the definition of the cover 130 being fixed to the communicating plate 15 includes being fixed via another member such as the compliance substrate 45 between the cover 130 and the communicating plate 15, and includes the cover 130 being directly fixed to the communicating plate 15. Incidentally, the compliance substrate 45 is not limited to being fixed to the nozzle plate 20 side of the communicating plate 15, and, for example, the compliance substrate 45 may be provided on an opposite side from the communicating plate 15 in relation to the manifold 95, that is, may be provided on the case 40 side, and the compliance substrate 45 may be provided on the side surface of the manifold 95 which intersects the communicating plate 15 side. Similarly for the nozzle plate 20, the definition of the nozzle plate 20 being fixed to the communicating plate 15 includes the nozzle plate 20 being directly fixed to the communicating plate 15, and includes being fixed via another member between the nozzle plate 20 and the communicating plate 15.

Due to the nozzle plate 20 and the cover 130 being fixed to the communicating plate 15 in this manner, a level difference is formed between the first nozzle surface 20*a* of the nozzle plate 20 and the second nozzle surface 135 of the cover 130 on the nozzle surface which is the Z1 side surface of the head main body 100, and a recess 140 is formed by the level difference. In other words, due to the first nozzle surface 20*a* of the nozzle plate 20 and the second nozzle surface 135 of the cover 130 being provided in different positions in the third reference direction Z, the level difference is provided between the first nozzle surface 20*a* and the second nozzle surface 135. In other words, the level difference refers to an element formed of two surfaces which are provided in different positions in the third reference direction Z. In the present embodiment, the level difference is formed due to the second nozzle surface 135 of the cover 130 being provided to protrude further to the Z1 side than the first nozzle surface 20*a* of the nozzle plate 20. By providing the cover 130 to protrude further to the recording sheet S side than the nozzle plate 20, it becomes difficult for the recording sheet S to contact the nozzle plate 20, and it is possible to suppress the deformation and peeling of the nozzle plate 20 which is caused by the recording sheet S contacting the nozzle plate 20. The nozzle surface of the present embodiment includes the first nozzle surface 20*a* of the nozzle plate 20 and the second nozzle surface 135 of the cover 130. Incidentally, even if the first nozzle surface 20*a* and the second nozzle surface 135 are provided in the same position in the third reference direction Z, for example, in a case in which the surface of the communicating plate 15 is exposed between the first nozzle surface 20*a* and the second nozzle surface 135, a level difference is formed between the first nozzle surface 20*a* and the second nozzle surface 135 and the communicating plate 15. In other words, the surface of a member such as the communicating plate 15 which is provided between the first nozzle surface 20*a* and the second nozzle surface 135 is included in the nozzle surface. The recess 140 is formed by the level difference which is provided in this nozzle surface. Incidentally, the recess 140 may be a corner-shaped recess formed by two surfaces, and may be a groove-shaped recess with a rectangular cross-section which is formed by three surfaces. Although described later in detail, in the present embodiment, a recess 25 is formed between the first nozzle surface 20*a* and the second nozzle surface 135 by the nozzle plate 20, the cover 130, and the communicating plate 15, and the slope-shaped recess 140 is formed in the surface of a filler 26 due to the inside of the recess 25 being filled with the filler 26. Note that, in a case in which the inside of the recess 25 is not filled with the filler 26, the recess 25 becomes a recess which is formed by the level difference. In other words, a recess which is formed by a level difference may be the recess 25 which is formed by the nozzle plate 20, the cover 130, and the communicating plate 15, and may be a slope-shaped recess which is formed in the surface of the filler 26 with which the inside of the recess 25 is filled. In the present embodiment, the exposed opening sections 134 are provided for each of the nozzle plates 20, and the nozzle plates 20 and the exposed opening sections 134 have parallelogram shapes inclined in the fourth reference direction Xa when viewed in plan view from the third reference direction Z. Therefore, the recess 140 between the nozzle plate 20 and the cover 130 is provided along the fourth reference direction Xa which is the direction in which the nozzles 21 are provided to line up. In the present embodiment, the recess 140 is provided continuously along the circumference of the nozzle plate 20. In other words, the recess 140 is provided to surround the plurality of nozzles 21 on a plane which is defined by the fourth reference direction Xa and the second reference direction Y. In the present embodiment, in the second reference direction Y which is the second direction, a distance $l_1$ between the nozzle 21 which is closest to the recess 140 and the recess 140, that is, the edge of the nozzle plate 20 is smaller than a distance $l_2$ between two of the nozzles 21 which are most separated in the second reference direction Y. Accordingly, although described in detail later, the ink which is caused to spill from the nozzles 21 travels easily to the recess 140, and it is easy to fill the recess 140 with the ink.

The recess 25 is formed between the nozzle plate 20 and the cover 130. In other words, since the exposed opening section 134 of the cover 130 has a larger opening than the nozzle plate 20, the recess 25 is formed on the surface of the communicating plate 15 between the outer circumferential edge portion of the nozzle plate 20 and the inner circumferential edge portion of the exposed opening section 134 of the cover 130. In other words, the recess 25 is defined by the nozzle plate 20, the cover 130, and the communicating plate 15 to which the nozzle plate 20 and the cover 130 are fixed. The inside of the recess 25 is filled with the filler 26. The filler 26 is formed in a slope shape to assume a position on the Z2 side which is lower than the first nozzle surface 20*a* on the nozzle plate 20 side and is a position on the Z2 side which is lower than the surface of the Z1 side of the cover 130 on the cover 130 side. Accordingly, on the nozzle surface, the slope-shaped recess 140 is formed in the surface of the filler 26. In other words, the surface of the Z1 side of the filler 26 which is provided in the recess 25 forms a portion of the nozzle surface of the head main body 100. By defining the height of the filler 26 in this manner, it is possible to suppress the generation or the like of foreign matter caused by the peeling of the filler 26 due to the wiper contacting the filler 26 when the surface of the Z1 side of the cover 130 and the first nozzle surface 20*a* of the nozzle plate 20 are wiped using the wiper. Naturally, a configuration may be adopted in which the inside of the recess 25 is not filled with the filler 26. Providing the recess 25 using the outer circumferential edge portion of the nozzle plate 20 in this manner enables the reduction of the surface area of the first nozzle surface 20*a* of the nozzle plate 20 and the close disposition of the nozzle 21 and the recess 140. Therefore, although described later in detail, it is easy to fill the recess 140 of the surface of the filler 26 which is provided inside the recess 25 which is formed by the level difference with the ink which is caused to spill out from the nozzles 21. The filler 26 is not particularly limited as long as the filler 26 is a liquid resistant material, and, for example, a resin material such as an adhesive or a mold material may be used as the filler 26. The filler 26 may be a portion of the adhesive which adheres the cover 130 to the compliance substrate 45. Since the filler 26 is formed of a resin material, the ink easily remains on the surface thereof. In particular, in a case in which a water repelling film which is water repellent in relation to the ink is provided on the surface of the Z1 side of the nozzle plate 20 and on the surface of the Z1 side of the cover 130 such that the ink does not easily adhere thereto, the ink which is adhered to the surface of the nozzle plate 20 and the cover 130 easily moves to the surface of the filler 26 and remains thereon. In other words, the first nozzle surface 20*a* of the nozzle plate 20 is more water repellent than the recess 25 or the surface of the filler 26 with which the recess 25 is filled, that is, the inner surface of the recess 140.

The case 40 is provided with an inlet path 44 for communicating with the manifold 95 and supplying the ink to each of the manifolds 95. The case 40 is provided with a connecting port 43 which communicates with the through hole 32 of the protective substrate 30 and through which the wiring substrate 98 is inserted.

In the head chip 110 which is configured in this manner, when the ink is ejected, the ink is taken in from the liquid supply unit 8 via the inlet path 44, and the inner portion of the flow path from the manifold 95 to the nozzles 21 is filled with the ink. Subsequently, the diaphragm is deformed by being caused to warp together with the piezoelectric actuator 300 by applying a voltage to each of the piezoelectric actuators 300 corresponding to the pressure generating chambers 12 according to a signal from the drive circuit 97. Accordingly, the pressure within the pressure generating chamber 12 rises, and ink droplets are ejected from the predetermined nozzles 21.

Figure 8A:
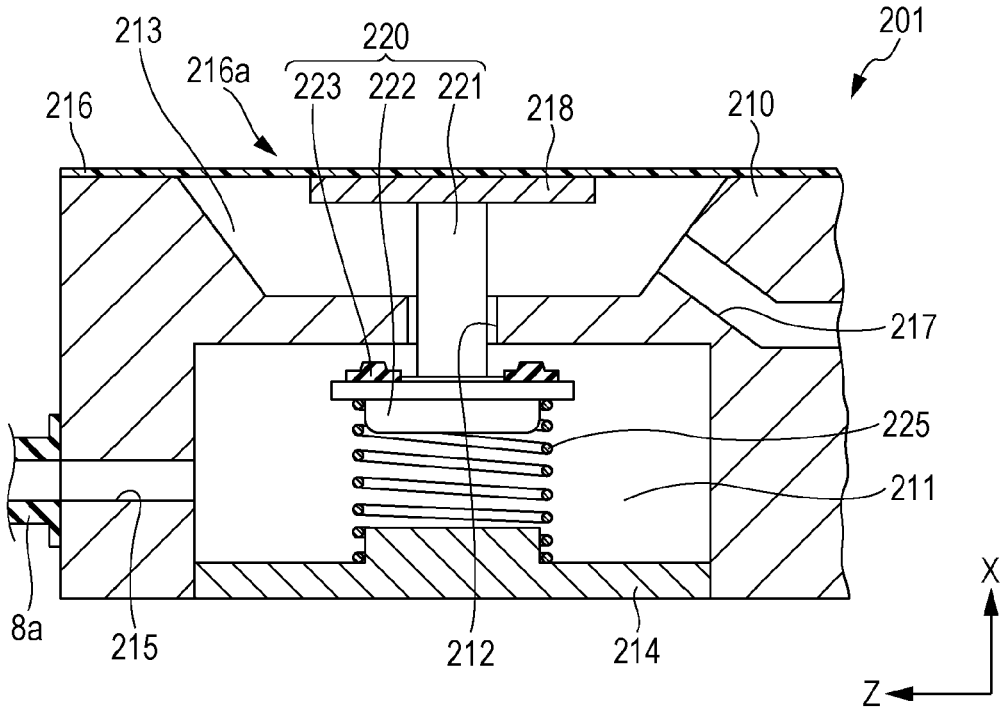
FIGS. 8A and 8B are sectional diagrams of a pressure adjustment unit according to the first embodiment of the invention.
Figure 8B:
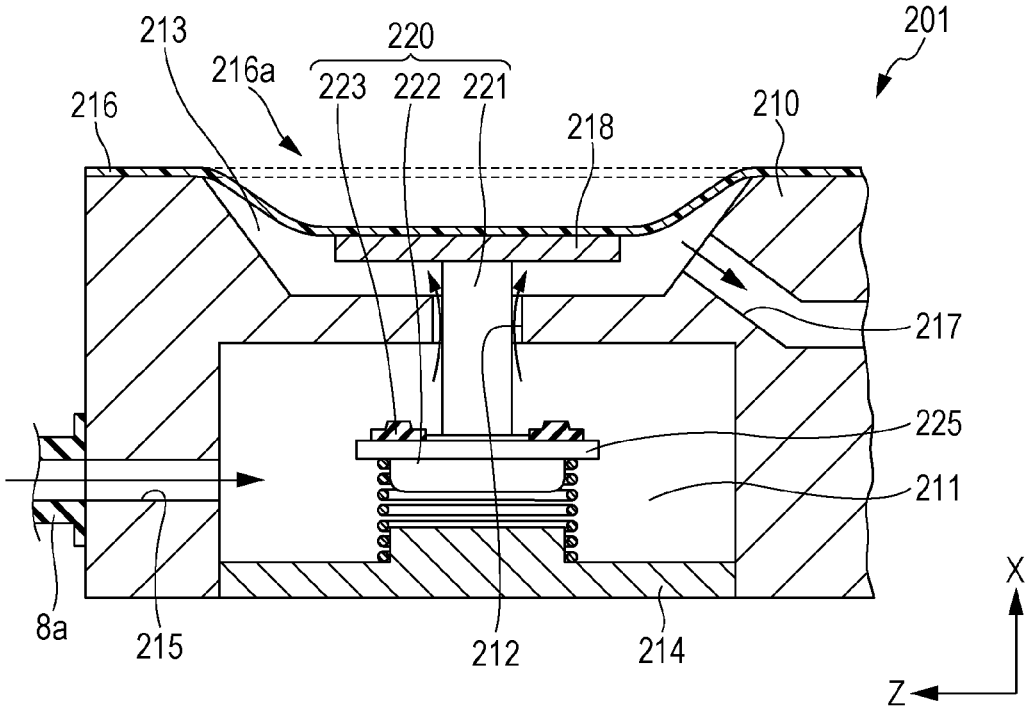

Here, description will be given of an example of the pressure adjustment unit 201 which is provided in the holding member 200, with reference to FIGS. 8A and 8B. FIGS. 8A and 8B are sectional diagrams illustrating the pressure adjustment unit of the present embodiment.

As illustrated in FIGS. 8A and 8B, the pressure adjustment unit 201 is a valve which is provided part way down the flow path communicating the liquid supply unit 8 with the head main body 100, and opens and closes the flow path. Specifically, the pressure adjustment unit 201 of the present embodiment is provided with a valve seat 210 a valve body 220.

The valve seat 210 is provided with a housing 211 and a first pressure adjustment chamber 213. The housing 211 is connected to the liquid supply unit 8 via the supply tube 8*a*, and the first pressure adjustment chamber 213 communicates with the housing 211 via a communication port 212 and communicates with the head main body 100.

The housing 211 is formed by sealing a recess which is formed in one surface of the valve seat 210 using a cover member 214. An inlet 215 which communicates the housing 211 with the liquid supply unit 8 is provided in the valve seat 210.

The first pressure adjustment chamber 213 has a recessed shape which is open to the side surface of the valve seat 210 on the opposite side from the housing 211. A film 216 is attached to the surface of the valve seat 210 in which the first pressure adjustment chamber 213 is opened, and the opening of the first pressure adjustment chamber 213 is sealed by the film 216. One end of an outflow path 217 communicates with the first pressure adjustment chamber 213, and the other end of the outflow path 217 is connected to the head main body 100 side.

Here, it is possible to use a flexible material which has resistance to liquids as the film 216. It is preferable to use a material with low water permeability and low permeability to gases such as oxygen and nitrogen as the film 216. Examples of the material of the film 216 include a configuration in which a nylon film which is coated with vinylidene chloride (Saran) is adhesively laminated onto a high density polyethylene film or a polypropylene (PP) film. Polyethylene terephthalate (PET) or the like may be used as another material.

A portion of the film 216 which forms the wall surface of the first pressure adjustment chamber 213 is a diaphragm 216*a*. A pressure receiving plate 218 is provided on the surface of the first pressure adjustment chamber 213 side of the diaphragm 216*a*. The pressure receiving plate 218 has a disc shape with a smaller external shape than the diaphragm 216*a*. The pressure receiving plate 218 is provided to avoid allowing the valve body 220 which opens and closes the communication port 212 from directly abutting the film 216. It is possible to use a material with greater rigidity than the diaphragm 216*a*, for example, a resin, a metal, or the like as the pressure receiving plate 218.

The communication port 212 is provided on the bottom surface of the first pressure adjustment chamber 213 to perforate the first pressure adjustment chamber 213 in the thickness direction and communicate the first pressure adjustment chamber 213 with the housing 211, that is, the wall surface of the valve seat 210 which mutually faces the diaphragm 216*a*. The ink from the housing 211 flows into the first pressure adjustment chamber 213 via the communication port 212.

The valve body 220 is inserted through the communication port 212. The valve body 220 is provided with a shaft section 221, a flange section 222, and a seal member 223. The shaft section 221 is inserted through the communication port 212, the flange section 222 is provided on the end portion of the shaft section 221 which is inside the housing 211, and the seal member 223 is fixed to the flange section 222.

The shaft section 221 has a slightly smaller external diameter than the communication port 212 and an end portion thereof which is inside the first pressure adjustment chamber 213 abuts the center portion of the pressure receiving plate 218. The other end portion of the opposite side of the shaft section 221 from the one which abuts the pressure receiving plate 218 is disposed within the housing 211, and the flange section 222 is formed integrally with the other end portion which is inside the housing 211.

The flange section 222 is formed of a circular plate-shaped member. The seal member 223 which is formed of an elastic material such as a rubber or an elastomer is fixed to the flange section 222. The communication port 212 is closed by the seal member 223 abutting the valve seat 210.

A coil spring 225 is installed between the flange section 222 of the valve body 220 and the cover member 214 which partitions the housing 211, and the valve body 220 is biased to the first pressure adjustment chamber 213 side by the coil spring 225 using the axial direction of the shaft section 221 as the movement axial direction.

Here, the forces acting on the valve body 220 include the repulsive force of the film 216, the force acting on the pressure receiving plate 218 and the diaphragm 216*a* receiving the ink pressure of the first pressure adjustment chamber 213, the biasing force of the coil spring 225, and the force acting on the valve body 220 receiving the supply pressure of the ink.

The repulsive force of the film 216 is the force acting to restore the diaphragm 216*a* which is flexibly deformed to the original shape of the diaphragm 216*a*. The greater the deformation amount, that is, the flexing amount of the diaphragm 216*a*, the greater the repulsive force of the film 216. The repulsive force of the film 216 is transmitted to the shaft section 221 via the pressure receiving plate 218.

The force acting on the pressure receiving plate 218 and the diaphragm 216*a* receiving the ink pressure of the first pressure adjustment chamber 213 is represented by the product of the pressure receiving area of the pressure receiving plate 218 and the diaphragm 216*a* which receive the ink pressure and the ink pressure. The liquid within the first pressure adjustment chamber 213 flows downstream from the outflow path 217, and when the amount of the ink within the first pressure adjustment chamber 213 is reduced, the pressure difference between the ink pressure and the atmospheric pressure increases, and the force acting on the pressure receiving plate 218 and the diaphragm 216*a* increases. The force acting on the pressure receiving plate 218 and the diaphragm 216*a* acts on the valve body 220 via the shaft section 221 as a force in the valve opening direction.

The biasing force of the coil spring 225 is a force which biases the valve body 220 in the valve closing direction. In this manner, in the present embodiment, since the valve body 220 applies a force to the pressure receiving plate 218 in the opposite direction from the force acting on the pressure receiving plate 218 and the diaphragm 216*a* due to the pressure of the ink of the first pressure adjustment chamber 213 using the coil spring 225, in order to displace the pressure receiving plate 218 until the valve body 220 reaches the open valve position, it is necessary to lower the pressure of the ink within the first pressure adjustment chamber 213 to a lower pressure by an amount corresponding to the biasing force of the coil spring 225 (operating pressure).

In the pressure adjustment unit 201, as illustrated in FIG. 8B, the diaphragm 216*a* moves to the bottom surface of the first pressure adjustment chamber 213 due to the ink within the first pressure adjustment chamber 213 flowing downstream and the inside of the first pressure adjustment chamber 213 being reduced to a more negative pressure than the atmospheric pressure, and a gap is formed between the seal member 223 and the valve seat 210 of the valve body 220 and the communication port 212 opens, that is, the valve opens due to the pressure receiving plate 218 pushing the valve body 220 against the biasing force of the coil spring 225. When the inside of the first pressure adjustment chamber 213 is released from the reduced pressure due to the ink being supplied to from the housing 211 to the inside of the first pressure adjustment chamber 213 by the opening of the valve, as illustrated in FIG. 8A, the diaphragm 216*a* returns to the original position due to the biasing force of the coil spring 225, and the valve closes.

By providing the pressure adjustment unit 201 in the recording head 3, it is possible to supply the ink which is pumped from the first pump unit 802 of the liquid supply unit 8 to the head main body 100 at a predetermined pressure. In other words, it is possible to supply the ink by the amount of the ink which is consumed by the head main body 100 using the pressure adjustment unit 201. Accordingly, the ink within the head main body 100 is maintained at a negative pressure, an ink meniscus is formed on the nozzles 21, and it is possible to suppress the spilling out of the ink from the nozzles 21.

Figure 9:
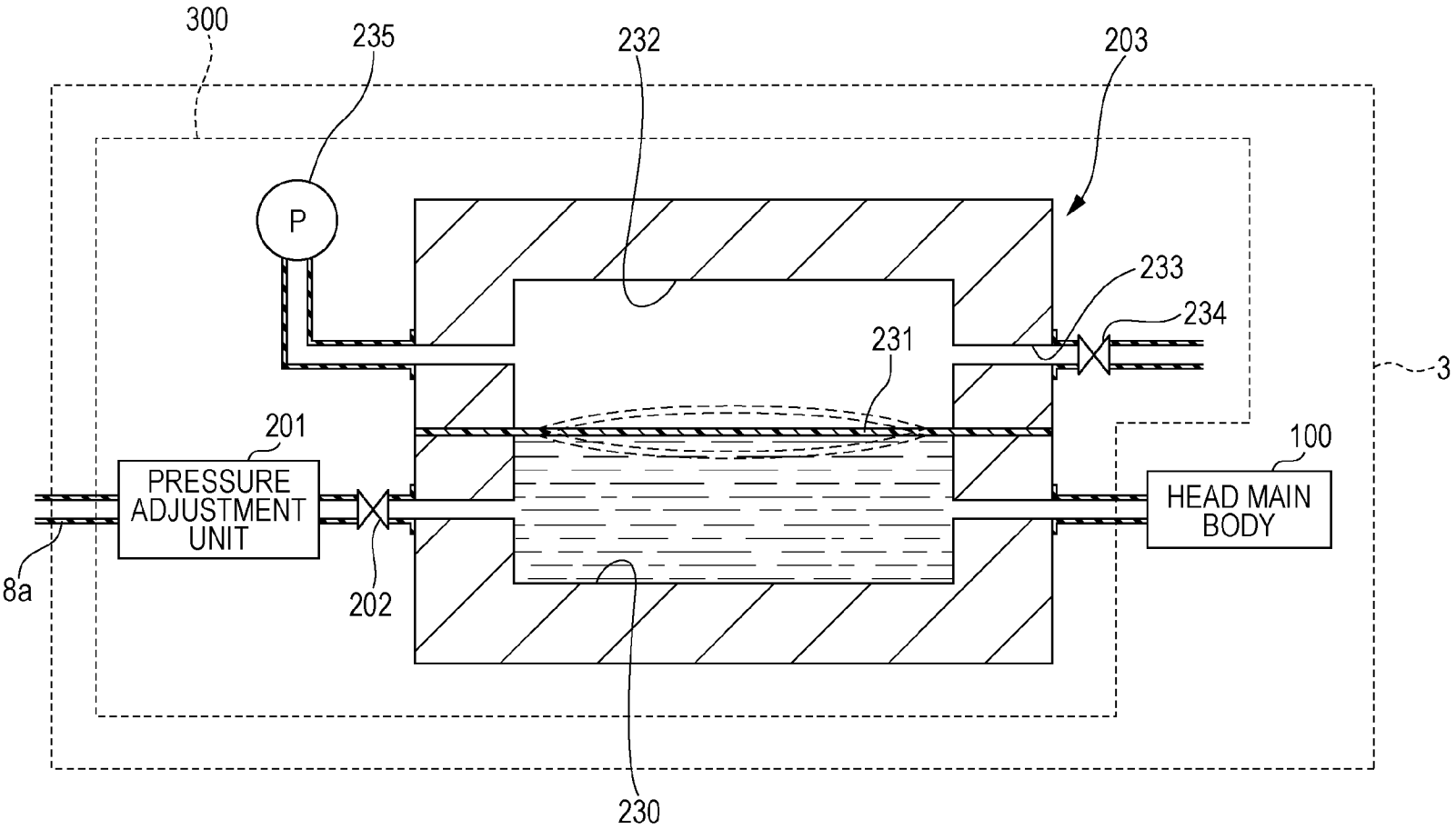
FIG. 9 is a sectional diagram of a pressurization unit according to the first embodiment of the invention.

Description will be given of an example of the pressurization unit 203 which is provided in the holding member 200, with reference to FIG. 9. FIG. 9 is a sectional diagram illustrating the pressure adjustment unit of the present embodiment.

As illustrated in FIG. 9, the pressurization unit 203 is provided with a second pressure adjustment chamber 230 and a pressurization chamber 232. The second pressure adjustment chamber 230 is connected to the pressure adjustment unit 201 and the manifold 95 of the head main body 100, and the pressurization chamber 232 is partitioned in the second pressure adjustment chamber 230 via a sheet-shaped wall section 231 which is formed of an elastic material.

The pressure adjustment unit 201 is connected to the second pressure adjustment chamber 230 via the valve 202, and the ink which is supplied from the pressure adjustment unit 201 is temporarily stored in the second pressure adjustment chamber 230. The second pressure adjustment chamber 230 communicates with the manifold 95 of the head main body 100, and the ink which is temporarily stored in the second pressure adjustment chamber 230 is supplied to the head main body 100.

An atmosphere release path 233 which communicates with the outside communicates with the pressurization chamber 232, and the pressurization chamber 232 communicates with the outside, that is, is open to the atmosphere, via the atmosphere release path 233. An atmosphere release valve 234 which opens and closes the atmosphere release path 233 is provided in the atmosphere release path 233, and the exposing of the pressurization chamber 232 to the atmosphere is controlled by the atmosphere release valve 234.

A second pump unit 235 which pumps a gas such as air into the pressurization chamber 232 is connected to the pressurization chamber 232. The gas within the pressurization chamber 232 is pressurized by the second pump unit 235 pumping the gas into the pressurization chamber 232 in a state in which the atmosphere release valve 234 closes the atmosphere release path 233. Due to the pressurization chamber 232 being pressurized, the wall section 231 deforms toward the second pressure adjustment chamber 230 side, the volume of the second pressure adjustment chamber 230 is reduced by the wall section 231, and thus, the ink within the second pressure adjustment chamber 230 is pressurized. By stopping the pressurization of the pressurization chamber 232 by the second pump unit 235 and opening the atmosphere release valve 234, the gas within the pressurization chamber 232 is discharged to the outside, and the pressure of the gas within the pressurization chamber 232 is reduced. Accordingly, the wall section 231 returns to the original orientation due to an elastic force, the volume of the second pressure adjustment chamber 230 returns to the original volume, and the pressurization of the ink within the second pressure adjustment chamber 230 is released.

When pressurizing the ink within the second pressure adjustment chamber 230, the valve 202 ensures that the ink does not flow to the pressure adjustment unit 201 side. This is because, for example, when the ink flows to the pressure adjustment unit 201 side, the film 216 of the pressure adjustment unit 201 flexibly deforms and absorbs the pressure. In other words, when pressurizing the ink using the pressurization unit 203, by suppressing the flowing out of the ink to the pressure adjustment unit 201 side, it is possible to efficiently send the pressurized ink to the head main body 100 side using the pressurization unit 203.

Figure 10A:
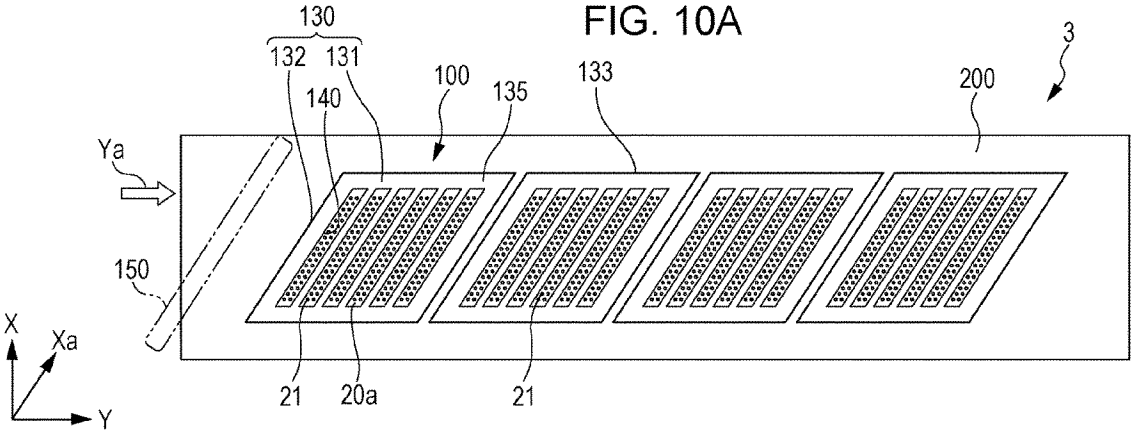
FIG. 10A is a plan diagram of a wiping unit according to the first embodiment of the invention.

Description will be given of an example of the wiping unit which is installed in the ink jet recording apparatus 1 and wipes the nozzle surfaces of the head main body 100, with reference to FIGS. 10A and 10B. FIG. 10A is a plan diagram illustrating the wiping unit from the nozzle surface side of the head module, and FIG. 10B is a sectional diagram illustrating the wiping unit from the nozzle surface side of the head module.

Figure 10B:
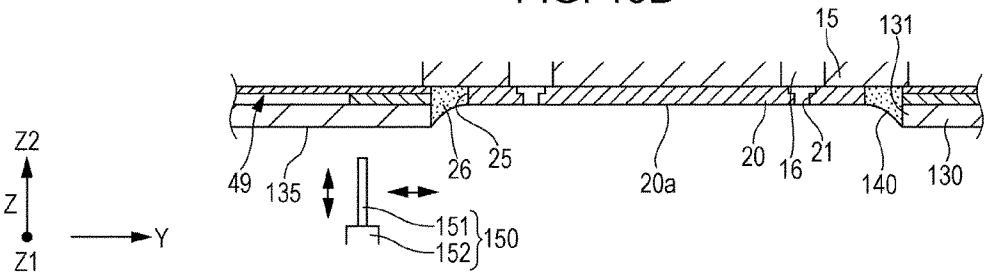
FIG. 10B is a sectional diagram of the wiping unit according to the first embodiment of the invention.

As illustrated in FIGS. 10A and 10B, in the present embodiment, a wiping unit 150 is provided with a wiper 151 and a wiper base section 152. The wiper 151 is formed of a plate-shaped member which is formed of an elastic material such as rubber or an elastomer, and the wiper 151 is fixed to the wiper base section 152.

The wiper base section 152 is provided to be capable of moving in a position facing the nozzle surfaces of the head main body 100. The wiper base section 152 is provided to be capable of being moved in the second reference direction Y by a drive unit such as a drive motor (not illustrated).

The base end portion side of the wiper 151 is fixed to the wiper base section 152 such that the distal end of the wiper 151 is a free end. The direction to which the surface direction of the wiper 151 is parallel is the fourth reference direction Xa. The distal end which is the free end of the wiper 151 is disposed to protrude toward the nozzle surface. The length of the wiper 151 in the fourth reference direction Xa is longer than the length of the nozzle row in which the nozzles 21 are provided to line up. Accordingly, the wiper 151 is capable of wiping the entire surfaces of the first nozzle surface 20*a* of the nozzle plate 20 and the second nozzle surface 135 of the cover 130.

In the wiping unit 150, the distal end of the wiper 151 wipes the second nozzle surface 135 of the cover 130 and the first nozzle surface 20*a* of the nozzle plate 20 due to the wiper 151 moving in the second reference direction Y relative to the head main body 100. In the present embodiment, a plurality (in the present embodiment, four) of the head main bodies 100 are wiped by the single wiper 151. Accordingly, it is possible to reduce the number of components and to reduce costs. Naturally, a configuration may be adopted in which the wiper 151 is provided for each of the head main bodies 100, or for each group of two or more of the head main bodies 100.

Figure 11:
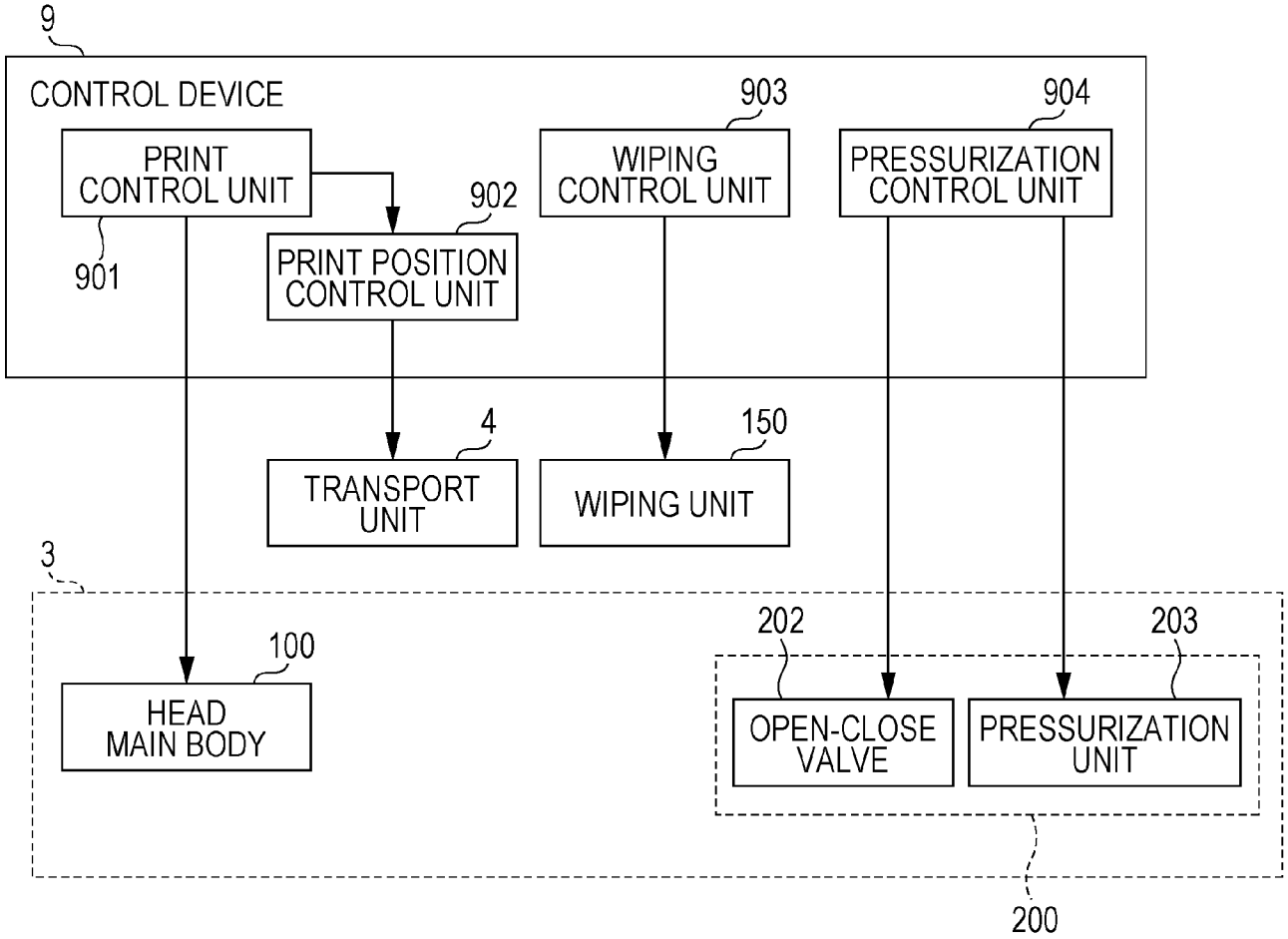
FIG. 11 is a block diagram illustrating the control configuration according to the first embodiment of the invention.

Description will be given of an example of a control device 9 of the ink jet recording apparatus 1, with reference to FIG. 11. FIG. 11 is a block diagram illustrating the control configuration of the recording apparatus of the present embodiment.

As illustrated in FIG. 11, the control device 9 is provided with a print controller 901, a print position controller 902, a wiping controller 903, and a pressurization controller 904.

The print controller 901 controls the print operations of the head main body 100, for example, applies a drive pulse to the piezoelectric actuator 300 together with the input of a print signal, and causes the ink to be ejected from the head main body 100.

The print position controller 902 controls the transport unit 4 to control the position of the recording sheet S relative to the head main body 100.

The wiping controller 903 controls the wiping unit 150 at a desired timing such as before or after the printing of the print controller 901, after a suction operation in which bubbles are suctioned together with the ink from the nozzles 21 using a suction unit (not illustrated), or the like, and the nozzle surface of the head main body 100 is wiped by the wiper 151.

During the wiping by the wiping unit 150, the pressurization controller 904 closes the valve 202, controls the pressurization unit 203 to pressurize the ink, and supplies the pressurized ink to the head main body 100.

The control device 9 uses the pressurization controller 904 to supply the pressurized ink to the head main body 100, and uses the wiping controller 903 to wipe the nozzle surface of the head main body 100 with the wiper 151. At this time, the pressurization controller 904 controls the pressurization unit 203 until at least the area of the recess 140 of the surface of the filler 26 which is formed by a level difference which mutually faces the nozzles 21 in the second reference direction Y is filled with the ink which spills out from the nozzles 21 of the head main body 100. In other words, as illustrated in FIG. 6, in a case in which an area w in which the plurality of nozzles 21 are distributed on the virtual line v is projected in the second reference direction Y in relation to a virtual line v which is parallel to the fourth reference direction Xa, the recess 140 which is filled with the ink is contained in the area w which is distributed on the virtual line v. In other words, when the virtual line v which is parallel to the fourth reference direction Xa is the recess 140 which is provided along the fourth reference direction Xa, when the nozzles 21 are projected in the second reference direction Y, the area w of the recess 140 in which the nozzles 21 are distributed may be filled with the ink. In other words, the plurality of nozzles 21 mutually oppose the area of the recess 140 which is filled with the ink in the second reference direction Y. In the present embodiment, since the recess 140 is provided to surround the two rows of nozzles 21, the entire circumference of the recess 140 is filled with the ink. Accordingly, the area w of the recess 140 is reliably filled with the ink. The wiping controller 903 controls the wiping unit 150 to wipe the recess 140 which is filled with the ink using the wiper 151, and to subsequently wipe the nozzles 21. When the ink is caused to spill from the nozzles 21, as described above, since the first nozzle surface 20*a* is more water repellent than the surface of the filler 26 which forms the inner surface of the recess 140, the ink easily moves from the first nozzle surface 20*a* to the surface of the filler 26, that is, to the recess 140. Since the recess 140, that is, the surface of the filler 26 is recessed in a slope shape, the ink easily travels along the recess 140 due to capillary action and fills the surface of the filler 26. Incidentally, the pressure at which to cause the ink to spill from the nozzles 21 due to the pressurization controller 904 controlling the pressurization unit 203 may be a pressure at which the ink is caused to spill from all of the nozzles 21, and may be a pressure at which the ink is caused to spill from a portion of the nozzles 21. In either case, the ink may be caused to spill from the nozzles 21 such that the area w of the recess 140 is filled with the ink. In this manner, by filling the area w of the recess 140 with the ink, it is possible to suppress the amount of wasteful consumption of the ink in comparison to filling all of the first nozzle surface 20*a* with the spilled ink. In the present embodiment, since the recess 140 is provided to surround the nozzles 21, it is possible to fill the recess 140 with the ink whichever of the nozzles 21 the ink is caused to spill from. In other words, even if the ink flows from the nozzles 21 toward the first reference direction X, it is possible to fill the area w with the ink along the recess 140 which is provided in the first reference direction X of the nozzles 21. In the present embodiment, the distance $l_1$ between the recess 140 and the nozzles 21 in the second reference direction Y is smaller than the distance $l_2$ between the nozzles 21 of the nozzle rows which are adjacent in the second reference direction Y. Therefore, since the recess 140 is disposed near to the nozzles 21, the ink which spills from the nozzles 21 easily fills the recess 140.

Description will be given of the wiping method in which the wiping unit 150 wipes the nozzle surface according to the control device 9, with reference to FIGS. 12A to 12D. FIGS. 12A to 12D are sectional diagrams of the main parts of the recording head and the wiping unit.

Figure 12A:
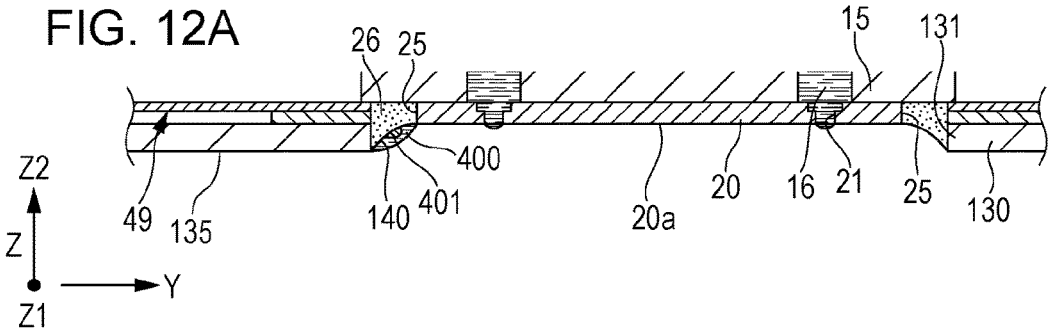
FIGS. 12A to 12D are sectional diagrams of a wiping method according to the first embodiment of the invention.

As illustrated in FIG. 12A, the pressurization controller 904 of the control device 9 controls the valve 202 and the pressurization unit 203 to cause the ink to spill from the nozzles 21 and to fill at least the area w (refer to FIG. 6) of the recess 140 with an ink 400. Note that, foreign matter 401 adheres easily not only to the first nozzle surface 20*a* of the head chip 110 and the second nozzle surface 135 of the cover 130, but also to the surface of the filler 26 which is provided in the recess 140. For example, the foreign matter 401 is formed due to an ink mist which is generated during the printing adhering to the first nozzle surface 20*a*, the second nozzle surface 135, and the like, and since the first nozzle surface 20*a* and the second nozzle surface 135 are hydrophobically treated, the ink which is adhered to the first nozzle surface 20*a* and the second nozzle surface 135 moves to the surface of the filler 26, and the ink dries on the surface of the filler 26, causing the viscosity of the ink to increase. In the present embodiment, it is possible to dissolve the foreign matter 401 with the ink 400 by filling the recess 140 with the ink by causing the ink to spill from the nozzles 21.

Figure 12B:
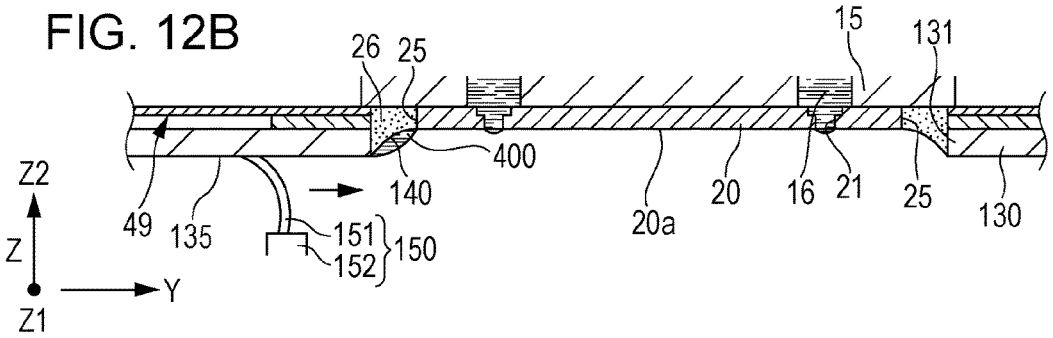

In this manner, the nozzle surface is wiped by the wiper 151 in a state in which the ink is pressurized by the pressurization unit 203. Specifically, as illustrated in FIG. 12B, the wiping controller 903 controls the wiping unit 150 to cause the wiper 151 to abut the second nozzle surface 135 of the cover 130, and to cause the wiper 151 to move toward the second reference direction Y, that is, toward the recess 140. Accordingly, the second nozzle surface 135 is wiped.

Figure 12C:
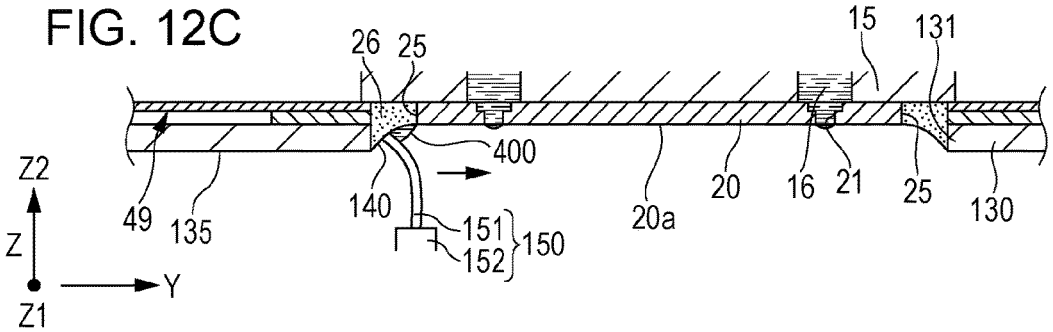
Figure 12D:
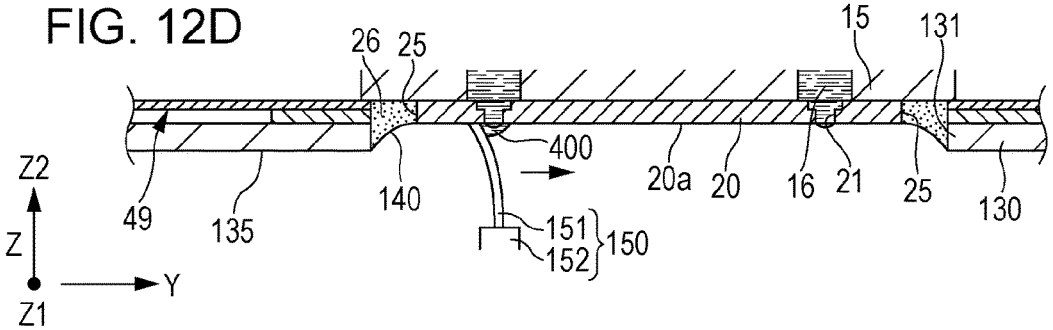

As illustrated in FIG. 12C, by moving the wiper 151 in the second reference direction Y, the ink 400 in which the foreign matter 401 of the surface of the filler 26 is dissolved is wiped by the wiper 151. The nozzles 21 are wiped by the wiper 151 due to the wiper 151 being further moved in the second reference direction Y. At this time, since the ink 400 in which the foreign matter 401 is dissolved adheres to the wiper 151 without the foreign matter 401 directly adhering to the wiper 151, even if the nozzles 21 are wiped by the wiper 151 to which the ink 400 is adhered, the foreign matter 401 is not rubbed into the nozzles 21 by the wiper 151, and it is possible to suppress the entrance of the foreign matter 401 to the inside of the nozzles 21. Since the first nozzle surface 20*a* of the head chip 110 is wiped by the wiper 151 to which the ink 400 in which the foreign matter 401 is dissolved is adhered, it is possible to dissolve the foreign matter which is adhered to the first nozzle surface 20*a* and wipe the first nozzle surface 20*a*.

Figure 13A:
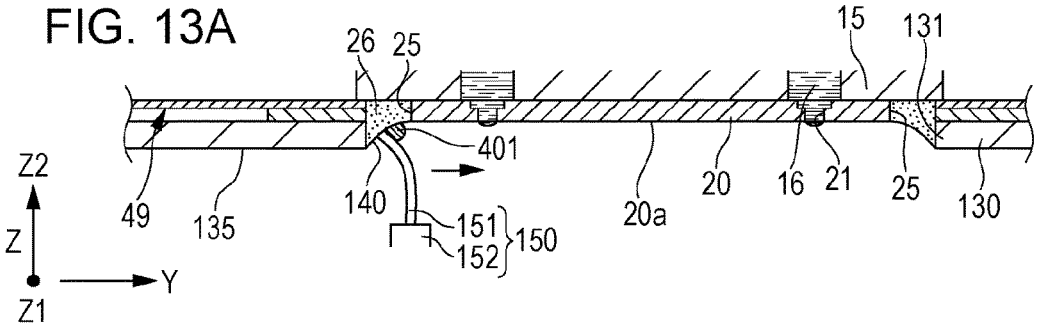
FIGS. 13A and 13B are sectional diagrams illustrating a comparative example of the wiping method according to the first embodiment of the invention.
Figure 13B:
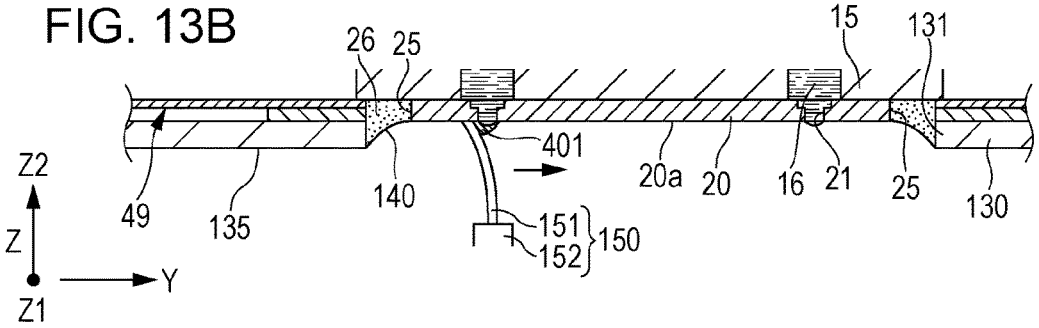

In contrast, for example, as illustrated in FIG. 13A, when the foreign matter 401 which is adhered to the surface of the filler 26 is directly wiped by the wiper 151, even if the ink within the nozzles 21 is pressurized by the pressurization unit 203, as illustrated in FIG. 13B, the foreign matter 401 which is adhered to the wiper 151, particularly viscosity-increased ink, is rubbed into the nozzles 21. When the foreign matter 401 is rubbed into the nozzles 21, clogging of the nozzles 21 arises, and ink ejection faults occur.

In other words, in the present embodiment, the foreign matter 401 which is adhered to the recess 140 is dissolved by the ink which is caused to spill from the nozzles 21, and the first nozzle surface 20*a* of the head chip 110 is wiped by the wiper 151 together with the ink of the recess 140. Accordingly, it is possible to suppress the rubbing of the foreign matter 401 of the first nozzle surface 20*a* of the head chip 110 or the recess 140 into the nozzles 21, and it is possible to suppress the occurrence of ejection faults such as clogging of the nozzles 21, reduction in ink weight, shifting in the ink landing position, and the like. In the present embodiment, since, instead of filling all of the first nozzle surface 20*a* with the ink which is caused to spill from the nozzles 21, at least the area w of the recess 140 may be filled with the ink, it is possible to suppress the amount of wasteful consumption of the ink.

In the recess 140, even if the foreign matter 401 which is still adhered to the recess 140 after the nozzles 21 are wiped in the second reference direction Y which is the movement direction of the wiper 151 adheres to the wiper 151, the foreign matter 401 is dissolved when the wiper 151 wipes the recess 140 which is filled with the ink before wiping the next first nozzle surface 20*a*. Therefore, even if the plurality of first nozzle surfaces 20*a* are wiped in succession by the wiper 151, it is possible to suppress the rubbing of the foreign matter 401 into the nozzles 21.

Incidentally, after wiping the nozzles 21 using the wiper 151, in order to form a meniscus on the nozzles 21, the pressurization of the ink by the pressurization unit 203 is stopped, by performing pre-ejection of ink droplets from the nozzles 21, so-called flushing, it is possible to favorably form a meniscus of ink on the nozzles 21.

As described above, in the ink jet recording apparatus 1 of the present embodiment, after filling the recess 140 with the ink, by moving the wiper 151 in the second reference direction Y relative to the nozzle surface in a state in which the ink within the nozzles 21 is pressurized, the wiper 151 wipes the nozzles 21 after wiping the recess 140. Therefore, the foreign matter 401 such as the viscosity-increased ink which is adhered to the first nozzle surface 20*a* or the recess 140 is dissolved by the ink, the rubbing of the foreign matter 401 into the nozzles 21 is suppressed, and it is possible to suppress the occurrence of ejection faults such as clogging of the nozzles 21 caused by the foreign matter 401, a reduction in the ink weight, and shifting in the ink landing position. Since the ink which fills the recess 140 may fill at least the area w, it is possible to suppress the consumption amount of the ink in comparison to a case in which the total surface of the nozzle surface or the total surface of the first nozzle surface 20*a* is filled with the ink. In the wiping method of the present embodiment, since the pressurization by the pressurization unit 203 may be performed at comparatively low pressurization, it is possible to use a small pressurization unit as the pressurization unit 203, and it is possible to reduce the size and cost of the pressurization unit 203.

In the present embodiment, the ink jet recording apparatus 1 is provided with the recording head 3, the liquid supply unit 8, the control device 9, and the wiping unit 150; however, it is possible to apply the invention of the present application to an ink jet recording head unit which is a liquid ejecting head unit which is provided with the recording head 3, the control device 9 which is a controller, and the wiping unit 150. In other words, an apparatus which includes the recording head 3, the control device 9, and the wiping unit 150 is referred to as an ink jet recording head unit (the liquid ejecting head unit).

In the present embodiment, although not particularly mentioned, for example, in a case in which the plurality of nozzles 21 which are provided to line up in the fourth reference direction Xa are divided into nozzles which eject a first type of ink (liquid) and nozzles which eject a second type of ink (liquid) with a smaller surface tension than the first type of ink (liquid), it is preferable that the recess 140 is filled with at least the second type of ink. This is because, since the surface tension of the second type of ink is smaller than the surface tension of the first type of ink, it is easier to break the ink meniscus of the nozzles 21 for the second type of ink, and it is easy to cause the ink to spill from the nozzles 21 and fill the recess 140. Since it is easier to break the ink meniscus of the nozzles 21 if the second type of ink is used, it is possible to further suppress the amount of wasteful consumption of the ink.

Second Embodiment

Figure 14A:
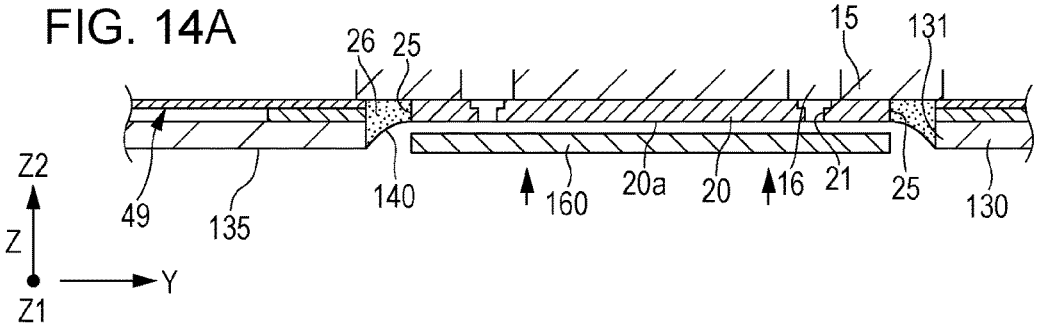
FIGS. 14A and 14B are sectional diagrams of the main parts of a recording apparatus according to a second embodiment of the invention.
Figure 14B:
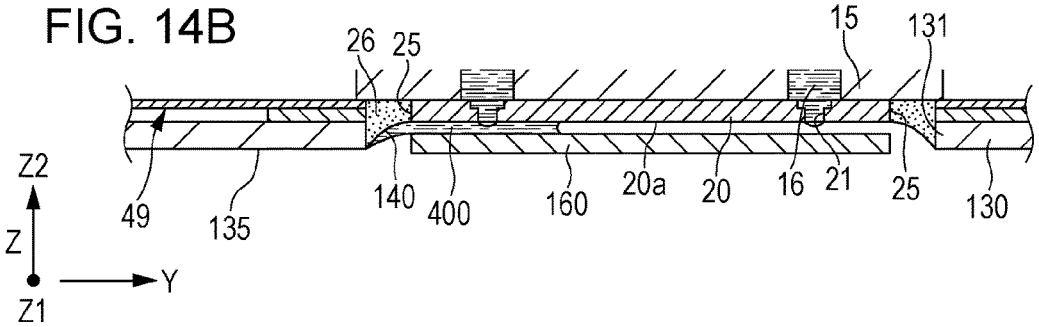

FIGS. 14A and 14B are sectional diagrams of the main parts of the recording head according to the second embodiment of the invention. Members which are the same as those in the embodiments described above are assigned the same reference signs and numerals, and redundant description will be omitted.

As illustrated in FIG. 14A, a liquid receiving plate 160 is provided in a position facing the first nozzle surface 20*a* of the head main body 100 of the present embodiment in the third reference direction Z. The liquid receiving plate 160 is formed of a plate-shaped member, is provided to be capable of movement in the third reference direction Z, and is disposed at a position close to the first nozzle surface 20*a* at a desired timing.

In the present embodiment, when filling the recess 140 with the ink before wiping the nozzle surface using the wiping unit 150, as illustrated in FIG. 14B, the ink is caused to spill out from the nozzles 21 after the liquid receiving plate 160 is caused to approach the first nozzle surface 20*a*. Accordingly, the ink spreads between the first nozzle surface 20*a* and the liquid receiving plate 160, and it is possible to easily cause the ink to move to the recess 140. If the surface of the liquid receiving plate 160 is hydrophobically treated, the ink easily moves toward the recess 140.

The liquid receiving plate 160 is not limited to a plate-shaped member, and, for example, may be a mesh-shaped so-called filter, or the like.

Figure 15:
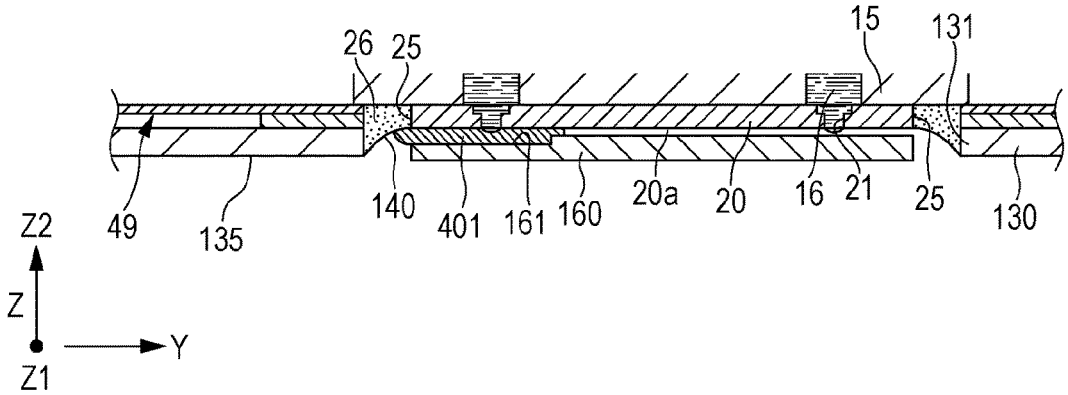
FIG. 15 is a sectional diagram of the main parts of a modification example of the recording apparatus according to the second embodiment of the invention.

Although the surface of the liquid receiving plate 160 which faces the first nozzle surface 20*a* is a flat surface, the liquid receiving plate 160 is not particularly limited thereto, and, for example, the liquid receiving plate 160 may include a groove to further guide the ink which spills out from the nozzles 21 to the recess 140. An example thereof is illustrated in FIG. 15. FIG. 15 is a sectional diagram of the main parts of the recording head illustrating a modification example of the liquid receiving plate.

As illustrated in FIG. 15, a groove 161 is provided from the nozzle 21 toward the recess 140 in the liquid receiving plate 160 on the surface mutually facing the first nozzle surface 20*a*. By providing the groove 161 in the liquid receiving plate 160 in this manner, the ink which spills out from the nozzles 21 moves within the groove 161 due to the capillary phenomenon, is easily guided to the recess 140, and it is possible to fill the recess 140 with the ink. Accordingly, it is possible to further suppress the consumption amount of the ink.

Third Embodiment

Figure 16:
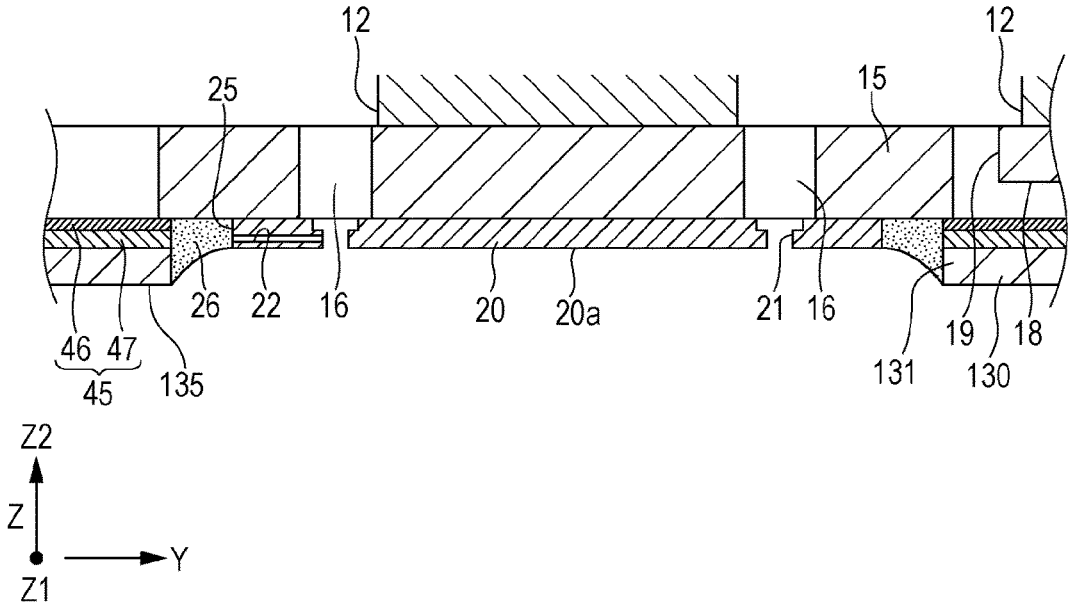
FIG. 16 is a sectional diagram of a recording head according to a third embodiment of the invention.

FIG. 16 is a sectional diagram of the main parts of the recording head according to the third embodiment of the invention. Members which are the same as those in the embodiments described above are assigned the same reference signs and numerals, and redundant description will be omitted.

As illustrated in FIG. 16, a communicating path 22 which communicates the inner surface of the nozzle 21 with the side surface of the recess 140 side of the outer circumferential edge portion of the nozzle plate 20 is provided nozzle plate 20. The communicating path 22 is provided part way into the thickness of the nozzle plate 20, and is not formed in the first nozzle surface 20*a*. The communicating path 22 is open in the filler 26 of the recess 25 closer to the Z1 side than the surface.

By providing the communicating path 22 in the nozzle plate 20 in this manner, when the ink is pressurized by the pressurization unit 203, it is possible to supply the ink within the nozzle 21 to the recess 140 via the communicating path 22. Therefore, it is possible to reliably fill the recess 140 with the ink with a low ink consumption amount.

Other Embodiments

Each of the embodiments of the invention are described above; however, the basic configuration of the invention is not limited to the above.

For example, in the first to third embodiments described above, during the wiping of the nozzle surface by the wiper 151, the control device 9 controls the pressurization unit 203 to cause the ink to spill from the nozzles 21 or to supply the ink from the communicating path 22 to the recess 140; however, the invention is not particularly limited thereto, and, for example, by providing a valve opening unit which forcefully releases the closed valve of the pressure adjustment unit 201 and supplying the ink which is pressurized by the first pump unit 802 to the head main body 100, the ink may be caused to spill from the nozzles 21, or the ink may be supplies from the communicating path 22 to the recess 140. In other words, the pressurization unit 203 may not be provided in the recording head 3. Naturally, both the pressurization unit 203 and the first pump unit 802 may be used.

In the first to third embodiments described above, the wiper 151 which is formed of a plate-shaped elastic member is used as the wiping unit 150; however, the invention is not particularly limited thereto, and, for example, the wiper 151 may be an expanded resin material such as a sponge, or a fabric material such as a non-woven fabric.

In the first to third embodiments described above, the cover 130 is not directly bonded to the nozzle plate 20; however, the invention is not particularly limited thereto, and, for example, the cover 130 may be directly bonded to the first nozzle surface 20*a* of the nozzle plate 20. Even in this case, a corner portion shaped recess which is formed of the two surfaces between the side surface of the cover 130 and the first nozzle surface 20*a* by a level difference between the first nozzle surface 20*a* and the second nozzle surface 135, the ink easily remains in the recess, and the remaining ink easily increases in viscosity and becomes the foreign matter 401.

In the first to third embodiments described above, the head chip 110 is provided with a plurality of members such as the flow path forming substrate 10, the communicating plate 15, the nozzle plate 20, the protective substrate 30, the compliance substrate 45, and the case 40; however, in order to eject the liquid from the nozzles 21 which are provided in the first nozzle surface 20*a*, the head chip 110 may be provided with at least pressure generation units which generate a pressure in the pressure generating chambers 12 which communicate with the nozzles 21, and a plurality of the pressure generating chambers 12 in which the pressure generation units are provided and which are provided to line up along a predetermined direction.

In the first to third embodiments described above, the recess 25 which is provided in the nozzle surface is filled with the filler 26; however, the invention is not particularly limited thereto, and, for example, the recess 25 may not be filled with the filler 26. By providing the recess 25 in this manner, it is possible to suppress the adherence of the ink which is stored in the recess 25 to the recording sheet S. It is possible to store the ink in the recess 25 by capillary action.

In the first to third embodiments described above, the plurality of head main bodies 100 are provided in the recording head 3; however, the number of the head main bodies 100 included in the single recording head 3 is not particularly limited, and there may be one, or two or more. The number of the head chips 110 included in the head main body 100 is also not limited to that which is described above, and may be one, or two or more.

In the first to third embodiments described above, the direction in which the nozzles 21 of the head chip 110 are lined up is disposed to be a direction which is inclined in relation to the second reference direction Y which orthogonally intersects the first reference direction X which is the transport direction; however, the direction in which the nozzle 21 are provided to line up may be set to the same direction as the first reference direction X which is the transport direction, and the direction in which the nozzle 21 are provided to line up may be set to the same direction as the second reference direction Y. The nozzles 21 are not limited to being provided in row formation, and the nozzles 21 may be disposed in matrix formation. In other words, if a plurality of the nozzles 21 are formed on the nozzle surface, the arrangement thereof is not particularly limited. In the first to third embodiments, the holder 120 is rendered to be substantially rectangular when viewed from the third reference direction Z which is perpendicular to the first nozzle surface 20*a*; however, the invention is not particularly limited thereto, and the holder 120 may be rectangular, trapezoidal, polygonal, or the like.

In the first to third embodiments described above, a so-called line type recording apparatus which performs printing by only fixing the recording head 3 to the apparatus main body 2 and transporting the recording sheet S is exemplified as the ink jet recording apparatus 1; however, the invention is not particularly limited thereto, and it is possible to apply the invention to a so-called serial type recording apparatus in which the recording head 3 is installed on a carriage which moves in a direction, for example, the second reference direction Y which intersects the first reference direction X which is the transport direction of the recording sheet S, and printing is performed while moving the recording head 3 in the direction which intersects the transport direction. The invention is not limited to a configuration in which the recording sheet S is transported relative to the recording head 3, and the printing may be performed using a configuration in which the recording head 3 is moved relative to the recording sheet S, and the recording sheet S may be transported relative to the recording head 3.

In the first to third embodiments described above, description is given using the piezoelectric actuator 300 which is laminated in the third reference direction Z as the pressure generation unit which generates pressure changes in the pressure generating chamber 12; however, the piezoelectric actuator 300 may be a thin-film type which is formed by film formation and lithography, and the piezoelectric actuator 300 may be a thick-film type which is formed using a method such as bonding green sheets. It is possible to use a longitudinal vibration type of the piezoelectric actuator 300 which has a piezoelectric material and an electrode forming material laminated alternately and expands and contracts in an axial direction. It is possible to use a pressure generation unit in which a heating element is disposed within the pressure generating chamber and which ejects droplets from the nozzles due to bubbles which are generated by the heating of the heating element, it is also possible to use a so-called electrostatic actuator which generates static electricity between the diaphragm and the electrodes, and causes the diaphragm to deform according to the static electricity to cause droplets to be ejected from the nozzles 21.

In the embodiments described above, description is given giving the ink jet recording head as an example of the liquid ejecting head, and the ink jet recording apparatus as an example of the liquid ejecting apparatus; however, the invention is widely targeted at liquid ejecting head units and liquid ejecting apparatuses which are provided with liquid ejecting heads in general, and, naturally, may be applied to a liquid ejecting head unit or a liquid ejecting apparatus which includes a liquid ejecting head that ejects a liquid other than an ink. Examples of other liquid ejecting heads include a variety of recording heads that are used in an image recording apparatus such as a printer, color material ejecting heads used in the manufacture of color filters of liquid crystal displays and the like, electrode material ejecting heads used to form electrodes of EL displays, field emission displays (FED) and the like, and biological organic matter ejecting heads used in the manufacture of bio-chips. It is possible to apply the invention to a liquid ejecting head unit and a liquid ejecting apparatus which are provided with the liquid ejecting head.

What is claimed is:

1. A liquid ejecting head unit comprising:

a liquid ejecting head which includes a nozzle surface provided with nozzles, the nozzle surface being on a plane defined by two directions including a first and a second directions intersecting each other;

a wiping unit comprising a wiper parallel to the first direction and configured to perform relative movement in the second direction between the wiper and the nozzle surface to wipe the nozzle surface;

a recess defined by an edge provided along the first direction on the nozzle surface; and a controller configured to control the liquid ejecting head to fill the recess with a liquid which spills from at least one nozzle among the nozzles prior to the wiping unit wiping the recess, and control the wiping unit to wipe the nozzle surface after wiping the recess which is filled with the liquid, and wherein an area is defined by a virtual line that is parallel to the first direction and a length in which the nozzles are projected in the second direction to the virtual line, the recess which is filled with the liquid being included in the area.

2. The liquid ejecting head unit according to claim 1, wherein the recess surrounds the nozzles on the plane.

3. The liquid ejecting head unit according to claim 1, wherein the nozzles are disposed in a plurality of positions in the second direction, and wherein a distance in the second direction between a nozzle closest to the recess in the second direction and the recess is smaller than a distance in the second direction between two nozzles which are most separated in the second direction.

4. The liquid ejecting head unit according to claim 1, wherein the recess is formed by a nozzle plate in which the nozzles are provided, a fixing plate in which a through hole surrounding the nozzle plate is provided, and a communicating plate to which the nozzle plate and the fixing plate are fixed.

5. The liquid ejecting head unit according to claim 4, wherein a surface of the nozzle plate to be wiped is more water repellent than the recess.

6. The liquid ejecting head unit according to claim 1, wherein the nozzles include nozzles which eject a first type of liquid, and nozzles which eject a second type of liquid which has smaller surface tension than the first type of liquid, and wherein the recess is filled with at least the second type of liquid.

7. The liquid ejecting head unit according to claim 1, further comprising:

a liquid receiving plate, wherein after causing the liquid to spill from at least one nozzle among the nozzles, the recess is filled with the liquid by causing the nozzle surface and the liquid receiving plate to approach each other.

8. The liquid ejecting head unit according to claim 7, wherein the liquid receiving plate includes a groove along a direction oriented from the nozzles toward the recess.

9. The liquid ejecting head unit according to claim 1, wherein the liquid is ejected to perform printing on an ejection target medium.

10. A liquid ejecting apparatus, comprising:

the liquid ejecting head unit according to claim 1.

11. A liquid ejecting apparatus, comprising:

the liquid ejecting head unit according to claim 2.

12. A liquid ejecting apparatus, comprising:

the liquid ejecting head unit according to claim 3.

13. A liquid ejecting apparatus, comprising:

the liquid ejecting head unit according to claim 4.

* * * * *